US012514387B2

(12) United States Patent
Pratsch

(10) Patent No.: US 12,514,387 B2
(45) Date of Patent: Jan. 6, 2026

(54) DISPLAY STAND WITH INTERIOR SHELF AND PRINTED EXTERIOR

(71) Applicant: The Imagine Group, LLC, Shakopee, MN (US)

(72) Inventor: Jeffrey Pratsch, Maple Grove, MN (US)

(73) Assignee: The Imagine Group, LLC, Shakopee, MN (US)

( * ) Notice: Subject to any disclaimer, the term of this patent is extended or adjusted under 35 U.S.C. 154(b) by 0 days.

(21) Appl. No.: 18/433,200

(22) Filed: Feb. 5, 2024

(65) Prior Publication Data

US 2024/0260766 A1 Aug. 8, 2024

Related U.S. Application Data

(60) Provisional application No. 63/443,320, filed on Feb. 3, 2023.

(51) Int. Cl.
*A47F 5/11* (2006.01)

(52) U.S. Cl.
CPC ..... *A47F 5/116* (2013.01)

(58) Field of Classification Search
CPC ..... A47F 5/116; A47F 5/114; A47F 5/112; A47B 47/06; A47B 43/02; A47B 55/06
USPC ..... 211/135, 72, 126.16, 149
See application file for complete search history.

(56) References Cited

U.S. PATENT DOCUMENTS

| | | | | |
|---|---|---|---|---|
| 5,443,168 | A * | 8/1995 | Dyment | A47F 5/116 211/186 |
| 7,703,864 | B2 * | 4/2010 | Moser | B65D 5/5213 312/261 |
| 8,485,370 | B2 * | 7/2013 | Dewhurst | A47F 5/0018 211/149 |
| 9,844,282 | B2 * | 12/2017 | Smith | A47B 43/02 |
| 9,907,414 | B2 * | 3/2018 | Heuer | A47B 96/021 |
| 10,463,176 | B1 * | 11/2019 | Sells | A47F 5/114 |
| 10,470,591 | B1 * | 11/2019 | Heiden | A47F 5/116 |
| 10,524,588 | B2 * | 1/2020 | Pratsch | A47B 43/02 |
| 10,531,750 | B1 * | 1/2020 | Heiden | A47F 5/0018 |
| 10,617,233 | B2 * | 4/2020 | Ertl | B65D 21/086 |
| 10,925,413 | B2 * | 2/2021 | Doane | A47B 43/02 |
| 11,457,751 | B2 * | 10/2022 | Nguyen | A47B 43/02 |
| 11,517,129 | B2 * | 12/2022 | Pfeifer | A47F 5/116 |
| 11,540,652 | B1 * | 1/2023 | Summerfield | A47F 5/114 |
| 2004/0148825 | A1 * | 8/2004 | Myers | A47F 5/116 40/124 |
| 2017/0245661 | A1 * | 8/2017 | Heuer | A47F 5/11 |
| 2020/0375375 | A1 * | 12/2020 | Robinson | A47B 55/06 |
| 2023/0397721 | A1 * | 12/2023 | Doane | A47F 5/114 |
| 2024/0260766 | A1 * | 8/2024 | Pratsch | A47F 5/116 |

* cited by examiner

*Primary Examiner* — Jennifer E. Novosad
(74) *Attorney, Agent, or Firm* — Winthrop & Weinstine, PA

(57) ABSTRACT

A display stand comprising an interior shelf section and an exterior printable unit including a shelf extension folded over a portion of the interior shelf section.

15 Claims, 28 Drawing Sheets

DISPLAY STAND WITH INTERIOR SHELF AND PRINTED EXTERIOR

CROSS-REFERENCE TO RELATED APPLICATIONS

The present application claims priority to U.S. Provisional Application 63/443,320 entitled Shelved Display Stand, filed on Feb. 3, 2023 the contents of which are incorporated by reference herein in its entirety. A claim of priority, to the extent appropriate, is made.

FIELD OF THE INVENTION

The present disclosure relates to a novel and advantageous display stand. In particular, the present disclosure relates to a novel and advantageous shelved display stand comprising an interior shelved unit and an exterior printable unit.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Temporary display units are common in retail. These may be placed throughout a store at the Point-of-Purchase (POP) or Point of Sale (POS). Commonly these are intended as disposable display units that carry high impact graphics for telling the consumer something about the product to be displayed on the display unit. Such displays are often cumbersome to assemble, flimsy, and expensive to customize.

There is a need in the art for a shelved display stand that is strong, easily customizable, and easy to assemble.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

A shelved display stand is disclosed. In one embodiment, the shelved display stand comprises an interior unit and an exterior unit. The interior unit has a front surface and a back surface. The front surface includes at least one shelf section and the back surface includes at least one slot for receiving the at least one shelf section. The exterior unit has a front surface and a back surface, and a bottom. The front surface includes at least one shelf extension. In an assembled condition, the interior unit front surface lines up with the exterior unit front surface and the interior unit back surface lines up with the exterior unit back surface and the at least one exterior unit shelf extension is folded over a portion of the at least one interior unit shelf section. In some embodiments, the shelved display stand may further comprise a header card.

The at least one shelf section may comprise a front fold line and a rear fold line wherein folding along the rear fold line forms a rear tab that is received by the at least one slot.

The interior unit back surface may include two slots for receiving the at least one shelf section. The at least one shelf section may comprise a front fold line and a rear fold line wherein folding along the rear fold line forms a rear tab that is received by the at least one slot. The at least one shelf extension comprises a front fold line and a panel. The interior unit shelf section may have a length that is less than a length of the exterior unit panel.

The exterior unit may be printed and the interior unit may not be printed. The interior unit may be reusable.

The interior unit may be formed from an interior unit blank, and wherein the interior unit blank comprises a plurality of vertical fold lines dividing the interior unit blank into a plurality of panels wherein one of those panels is a front surface panel correlating to the front surface and one of those panels is a back surface panel correlating to the back surface. Each of the interior unit blank, the exterior unit blank, and the header card is flat.

The exterior unit is formed from an exterior unit blank, and wherein the exterior unit blank comprises a plurality of vertical fold lines equal to or more than the plurality of vertical fold lines of the interior unit blank. The exterior unit blank may comprise a first side surface panel and a second side surface panel, wherein each of the exterior unit front surface panel, the exterior unit back surface panel, the exterior unit first side surface panel, and the exterior unit second side surface panel includes an extension piece, wherein the extension pieces cooperate to close the bottom of the shelved display stand.

In further embodiments, a method of forming a shelved display stand is provided. The method includes providing an interior unit blank, assembling an interior unit from the interior unit blank, providing an exterior unit blank, assembling an exterior unit from the exterior unit blank, inserting the interior unit into the exterior unit, and forming shelves in the unit.

The interior unit blank may comprise a plurality of vertical fold lines, wherein the plurality of vertical fold lines divides the interior unit blank into a plurality of panels including a front surface panel and a rear surface panel, wherein the front surface panel includes at least one shelf section comprising a front fold line and a rear tab and the rear surface panel includes at least one slot for receiving the at least one shelf section. Assembling the interior unit from the interior unit blank may be done by folding the interior unit blank along the vertical fold lines, folding the at least one shelf section along the front fold line, and inserting the rear tab into the at least one slot.

The exterior unit blank may comprise a plurality of vertical fold lines, wherein the plurality of vertical fold lines divides the exterior unit blank into a plurality of panels including a front surface panel and a rear surface panel, wherein the front surface panel includes at least one shelf extension comprising a front fold line and a shelf panel. The exterior unit blank may further comprise a first side panel and a second side panel, wherein each of the exterior unit front surface panel, the exterior unit back surface panel, the exterior unit first side surface panel, and the exterior unit second side surface panel includes an extension piece. Assembling the exterior unit from the exterior unit blank may be done by folding the exterior unit blank along the vertical fold lines. The method may further comprise folding the extension pieces to close a bottom of the shelved display stand.

In some embodiments, assembling the interior unit may further comprise adhering a first side end of the interior unit blank to a second side end of the interior unit blank and assembling the exterior unit may further comprise adhering a first side end of the exterior unit blank to a second side end of the exterior unit blank.

Forming a shelf in the combined unit may be done by folding the shelf extension along the front fold line and pressing the shelf panel along the shelf section.

The method may further comprise providing a header card and positioning the header card on the combined unit.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to a novel and advantageous display stand. In particular, the present disclosure relates to a novel and advantageous shelved display stand comprising an interior shelved unit and an exterior printable unit.

The shelved display stand may comprise a heavy-duty floor stand. The shelved display stand is easy to assemble—it can be assembled in 90 seconds or less by a single person using no hardware or applied adhesives. Because no hardware or applied adhesives are used in assembly or set up, the shelved display stand may easily be recycled. Further, it can be manufactured fully or partially from recycled materials. It is to be understood that shelved display stand and shelved display unit may be used interchangeably herein.

Figure 1:
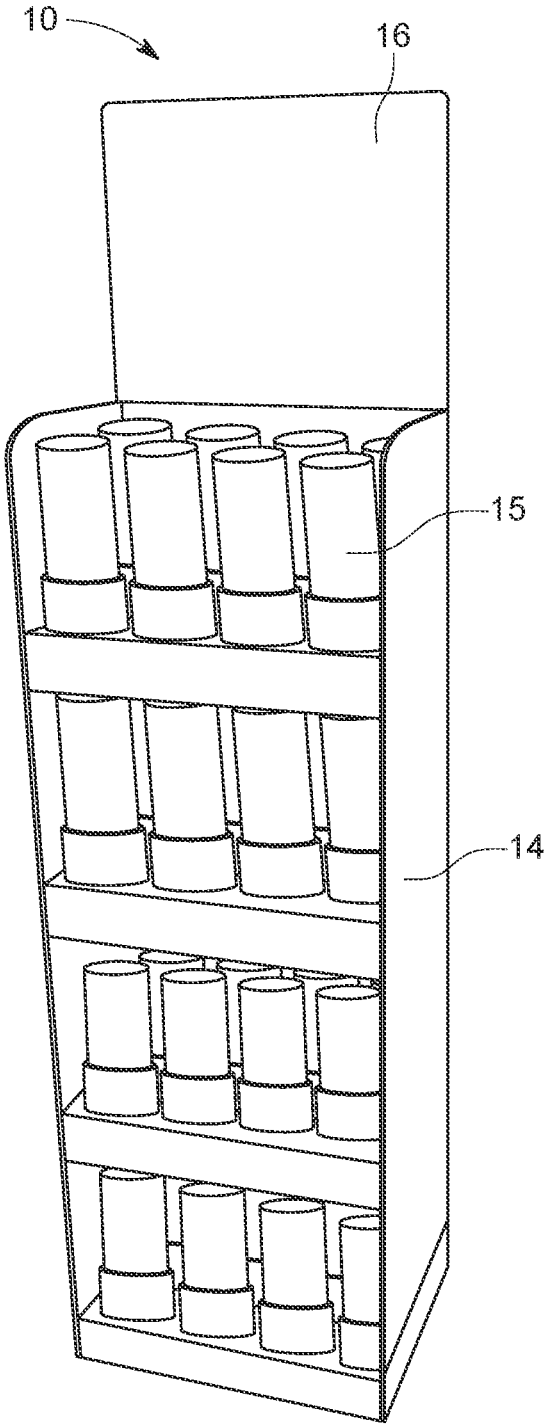
FIG. 1 illustrates a shelved display stand, in accordance with one embodiment.

FIG. 1 illustrates a shelved display stand 10 holding product 15, in accordance with one embodiment. The shelved display stand comprises two units: an interior unit (not visible) and an exterior unit 14. In the embodiment of FIG. 1, the shelved display stand 10 further includes a header card 16. Prior to assembly, each of the interior unit, the exterior unit, and header card may be flat. More specifically, each of the interior unit, the exterior unit 14, and the header card 16 maybe shipped flat. In the flat configuration, the interior unit 12 is referred to as an interior unit blank 112 and the exterior unit 14 is referred to as an exterior unit blank 114. The blanks are relatively small and easy to manufacture. The interior unit, the exterior unit, and the header may comprise the same material or may comprise different materials.

Embodiments of the shelved display stand, and more particularly of the interior unit, exterior unit, and the header, will now be described. It is to be appreciated that these embodiments are intended as non-limiting examples and variations will be obvious to one skilled in the art. For example, while a shelved display stand having four shelves is shown, the shelved display stand may have more or fewer shelves. The shelves may be uniformly spaced or may have varying spacing. Sides of the shelved display stand may be coterminous with an upper shelf or may be coterminous with a rear upper edge of the shelved display stand. Any provided dimensions or ratios are for example only. The shelved display stand can be formed in a variety of sizes. The ratio of height to width of each shelf space can be chosen as suitable for a specific product.

Figure 2:
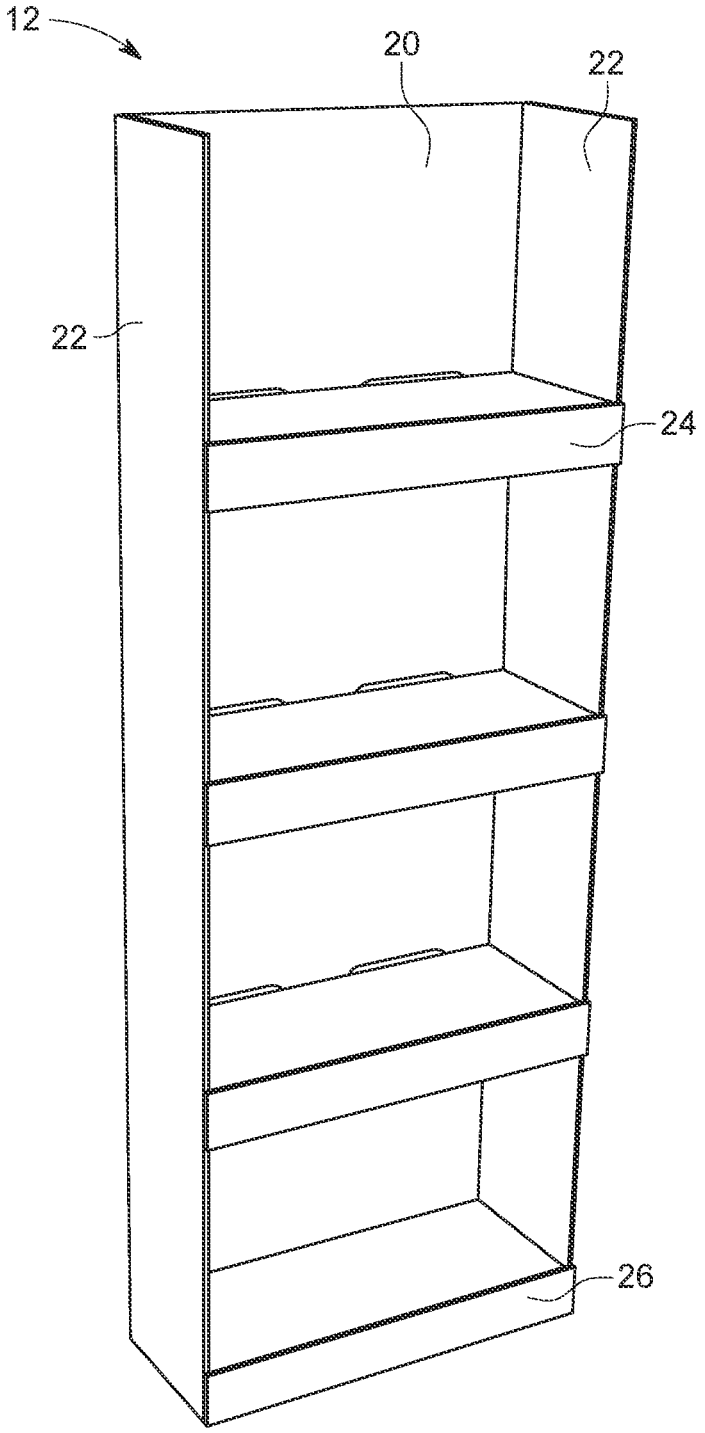
FIG. 2 illustrates an assembled interior unit of a shelved display stand, in accordance with one embodiment.

FIG. 2 illustrates an assembled interior unit 12, in accordance with one embodiment. As assembled, the interior unit comprises a back surface 20, first and second sides surfaces 22, a plurality of shelves 24, and a bottom surface 26. As shown, the bottom surface 26 maybe utilized as a shelf.

Figure 3A:
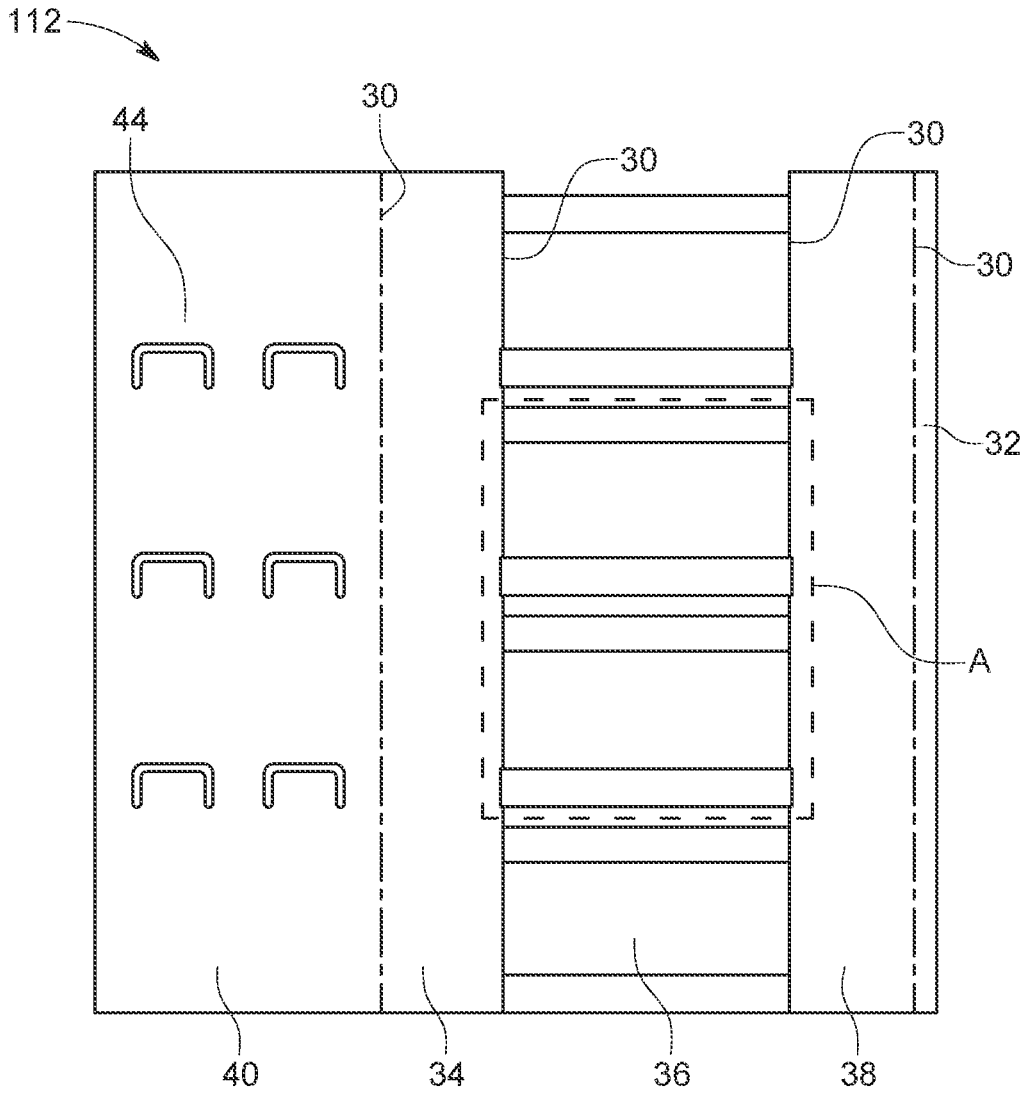
FIG. 3*a* illustrates a flat interior blank, in accordance with one embodiment.

FIG. 3*a* illustrates the interior unit in a flat, unassembled configuration. In this configuration, the interior unit may be referred to as an interior unit blank 112. FIG. 3*a* provides example measurements for portions thereof, for illustration only.

The interior unit blank 112 includes a plurality of vertical fold lines 30. In the embodiment shown, there are four vertical fold lines 30 and one vertical adhesive line 32. The vertical fold lines 30 divide the blank 112 into four panels, one each for forming: a left side surface 34, a front surface 36, a right side surface 38, and a rear surface 40. As assembled, the front surface 36 is a temporary construct, which is later divided into shelves. When the vertical fold lines are folded, the interior unit achieves a substantially rectangular configuration. In other embodiments, other numbers of fold lines may be provided such that the assembled unit may have a different three dimensional configuration. The rear surface panel 40 includes horizontal slots 44. The front surface panel 36 of the blank 112 includes a plurality of shelf sections for forming shelves of the assembled interior unit that cooperate with the slots 44.

Figure 3B:
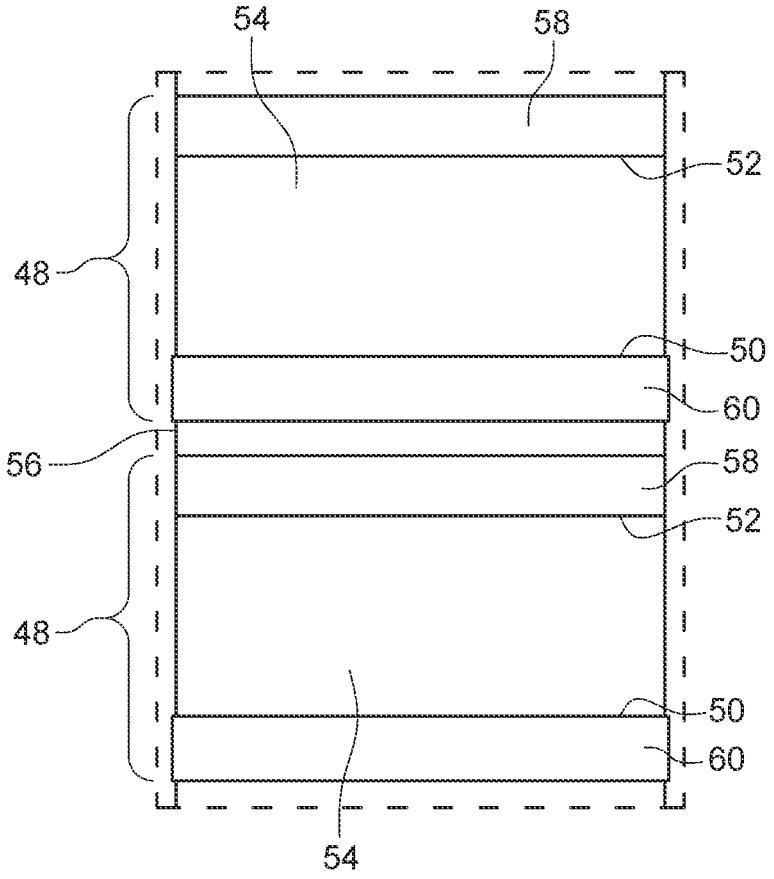
FIG. 3*b* illustrates Section A of FIG. 3*a*, in accordance with one embodiment.

FIG. 3*b* illustrates Section A of FIG. 3*a*. Each shelf section 48 comprises a front fold line 50 and a rear fold line 52, separated by panel 54. The shelf sections are separated by space 56. Folding along the rear fold line 52 forms rear tab 58. Folding along the front fold line 50 forms front shelf extension 60. The rear tab 58 is received by a slot 44. The height of the panel 54 corresponds to the depth of the formed shelf and the depth of the interior unit between the front surface panel and the rear surface panel. The height of the front shelf extension 60 corresponds to the front height of the shelf.

Figure 3C:
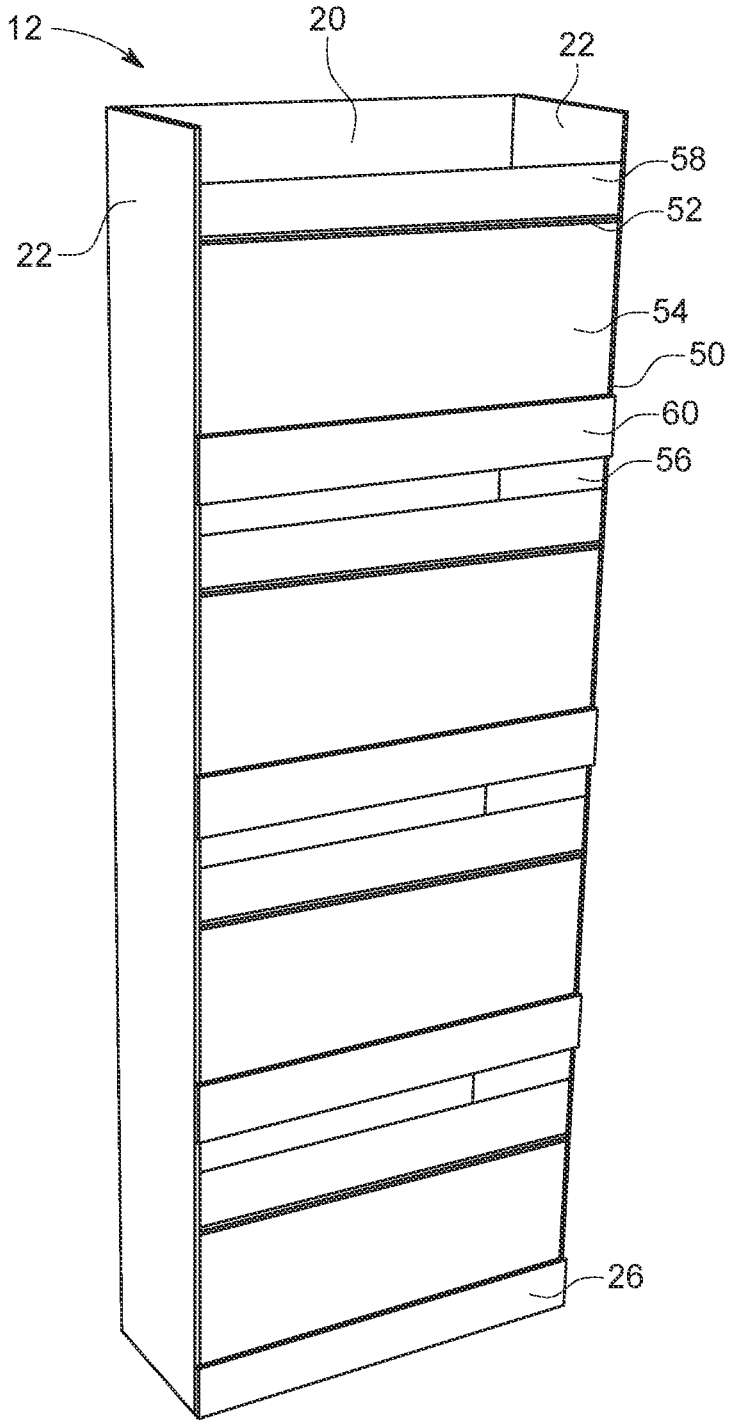
FIG. 3*c* illustrates a partially assembled interior unit, in accordance with one embodiment.
Figure 3D:
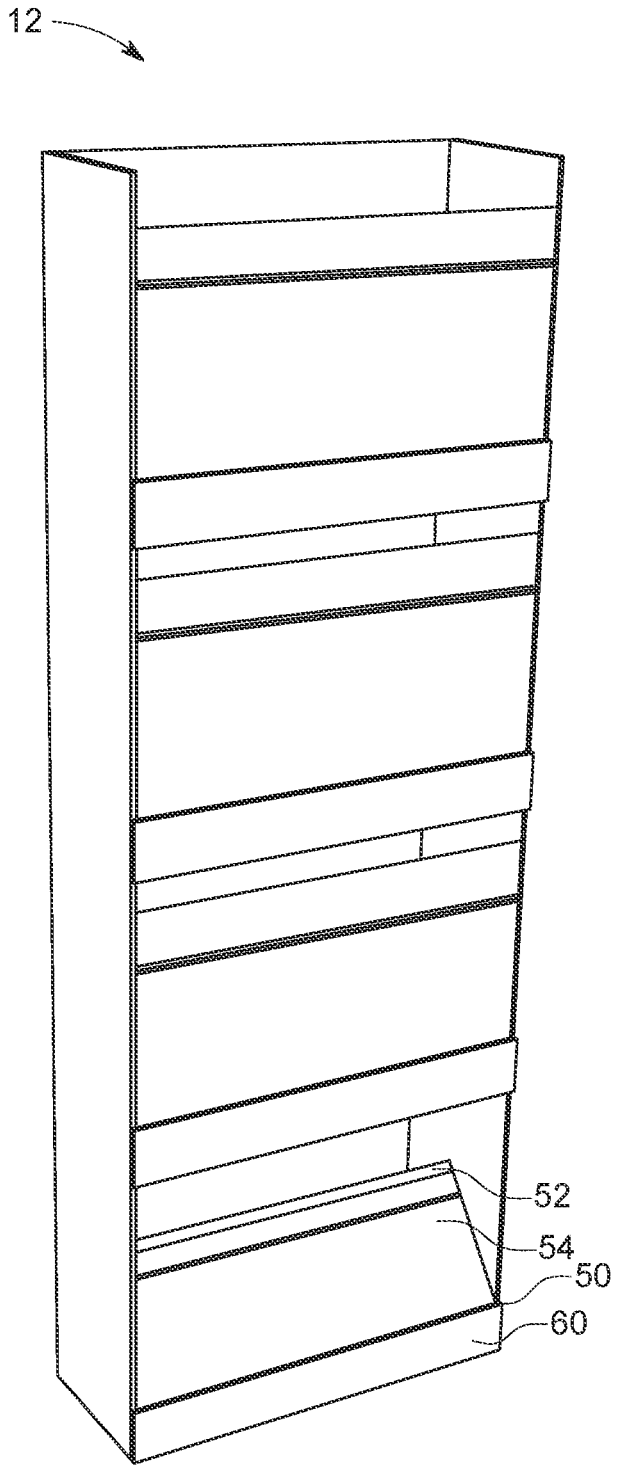
FIG. 3*d* illustrates the partially assembled interior unit of FIG. 3*c* further assembled, in accordance with one embodiment.
Figure 3E:
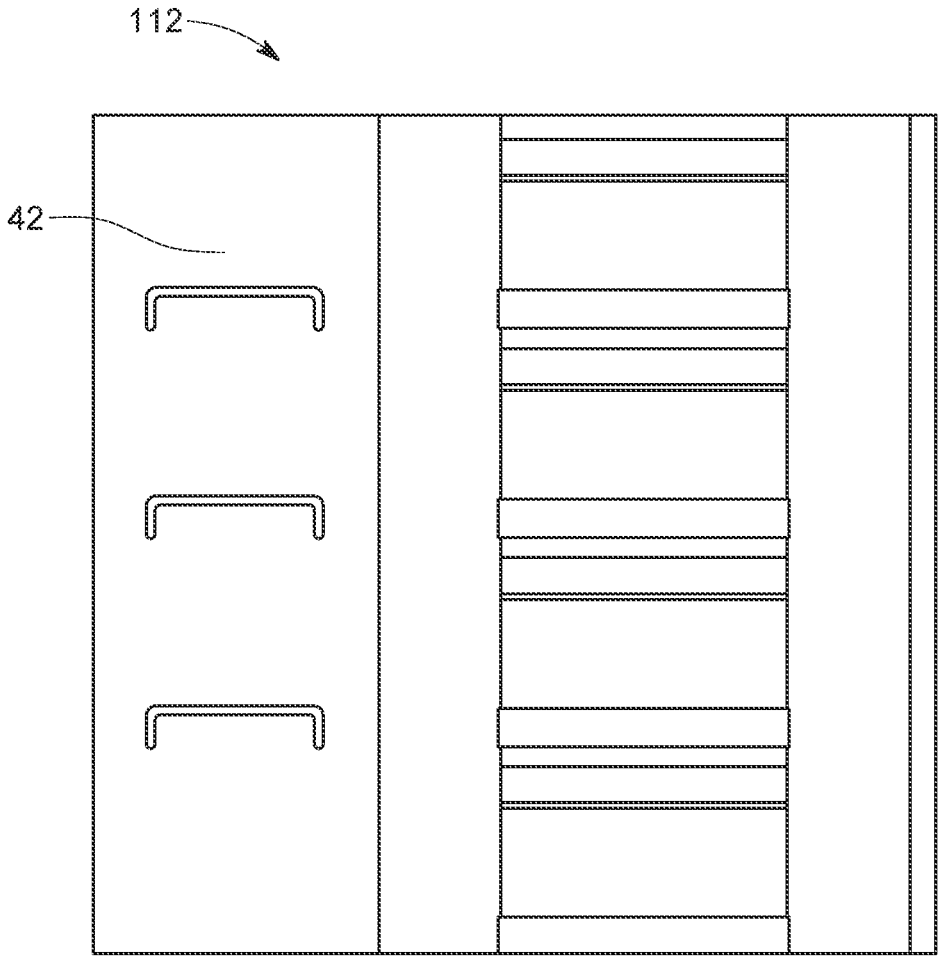
FIG. 3*e* illustrates an interior blank having a single slot per shelf, in accordance with one embodiment.

To assemble the interior unit, the blank is folded along the vertical fold lines 30 and the glue line 32 is exposed to adhere the right side panel 38 to the rear panel 40. This configuration is shown in FIG. 3*c*. To assemble each shelf, the front fold line 50 is folded and the panel 54 is directed rearwardly. The rear fold line 52 is folded downwardly and the rear tab 58 is inserted in the slot 44. FIG. 3*d* illustrates the interior unit with the bottom shelf being folded rearwardly. Slots 44 provided along the rear surface panel 40 receive the rear tabs 58 to generally fix the shelves in place. In various embodiments, each tab may be received by 1, 2, 3, or more slots. The embodiment of FIG. 3*a* illustrates two slots 44 for receiving each tab 58. While the slots are shown in groups of two per shelf, it is to be appreciated that more or fewer slots may be used as desired. FIG. 3*e* illustrates an embodiment having one slot 44 per shelf.

In some embodiments, a series of shelves are provided. These may be evenly spaced or unevenly spaced. While four shelves are shown, more or fewer shelves may be provided. These may be evenly spaced or unevenly spaced.

Figure 4:
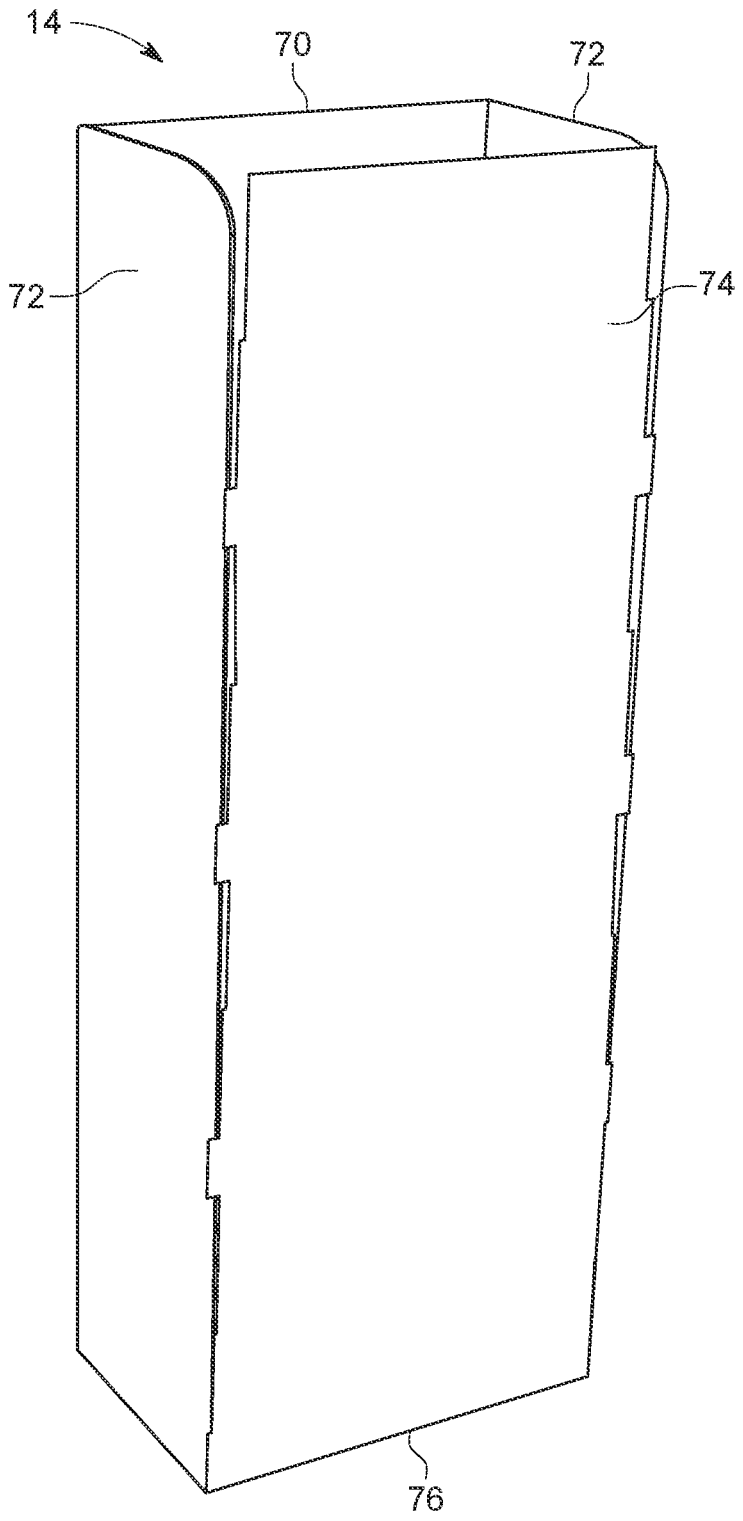
FIG. 4 illustrates an assembled exterior unit 14, in accordance with one embodiment.

FIG. 4 illustrates an assembled exterior unit 14, in accordance with one embodiment. As assembled, the exterior unit comprises a back surface 70, first and second sides surfaces 72, a front surface 74, and a bottom 76. The bottom 76 may be open or closed. The exterior unit has one or more panels corresponding to placement of one or more shelves of the interior unit.

Figure 5A:
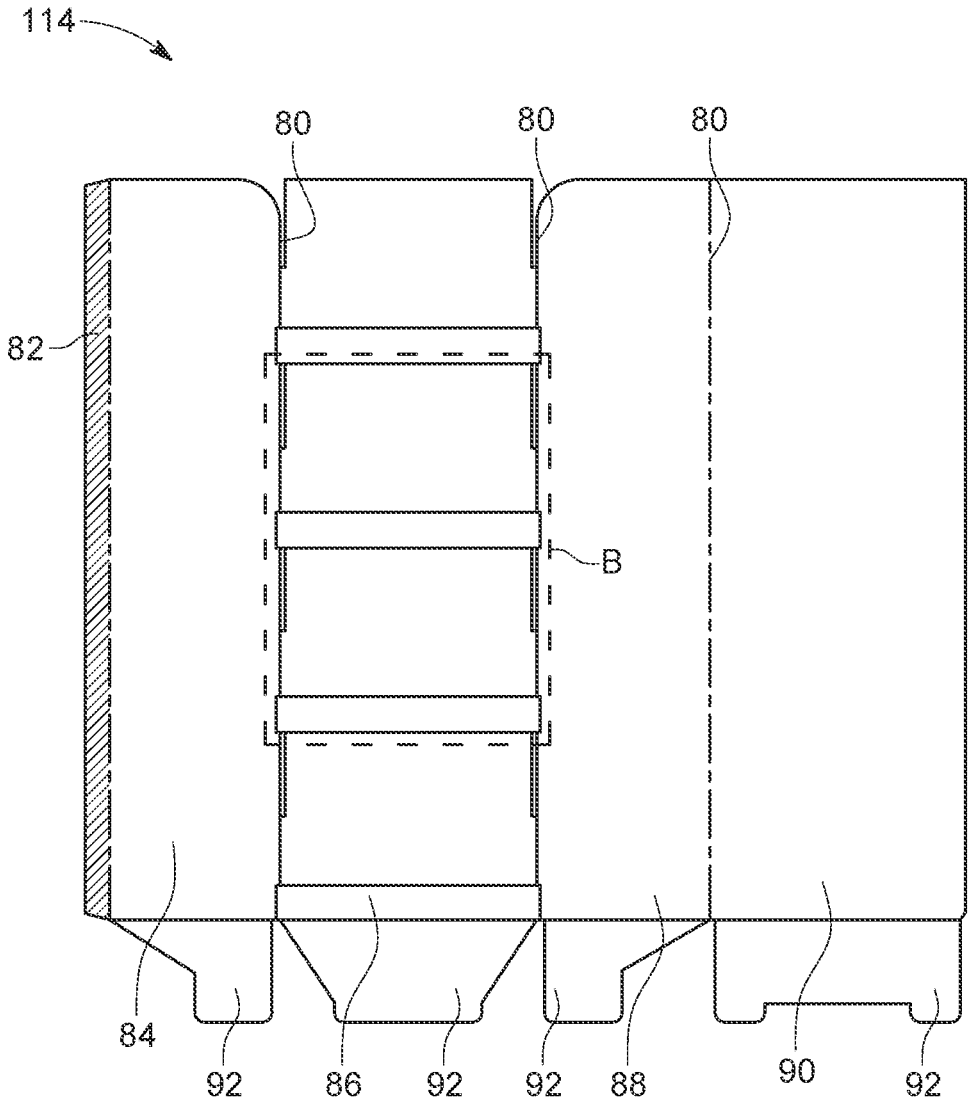
FIG. 5*a* illustrates a flat exterior blank, in accordance with one embodiment.

FIG. 5*a* illustrates the exterior unit in a flat, unassembled configuration. In this configuration, the interior unit may be referred to as an exterior unit blank 114. FIG. 5*a* provides example measurements for portions thereof, for illustration only.

The exterior unit blank 114 includes a plurality of vertical fold lines 80. In the embodiment shown, there are four vertical fold lines 80 and one vertical adhesive line 82. The vertical fold lines 80 divide the blank 114 into four panels, one each for forming: a left side surface 84, a front surface 86, a right side surface 88, and a rear surface 90. As assembled, the front surface 86 is a temporary construct, which is later divided into shelves. When the vertical fold lines are folded, the exterior unit achieves a substantially rectangular configuration. In other embodiments, other numbers of fold lines may be provided such that the assembled unit may have a different three dimensional configuration. The exterior unit 14 may have a three dimensional configuration different from the interior unit 12 three dimensional configuration so long as the interior unit 12 can be received by the exterior unit 14 and the panels of the exterior unit line up with the shelves of the interior unit (as described more fully below). In general, the exterior unit may have any number of sides.

In the embodiments shown, the interior unit shelf depth (and depth of unit) is less than the exterior unit shelf depth. In alternative embodiments, the interior unit shelf depth may be substantially the same as the exterior unit shelf depth.

The exterior unit blank may further comprise a plurality of cooperating extension pieces 92 along bottom edges of one or more of the left side surface 84, front surface 86, right side surface 88, or rear surface 90 that can be folded towards one another to form a bottom surface of the exterior unit. When the vertical fold lines are folded and the cooperating extension pieces folded, the exterior unit achieves a closed tubular configuration. In alternative embodiments, no extension pieces may be provided and the assembled exterior unit may have an open bottom.

Figure 5B:
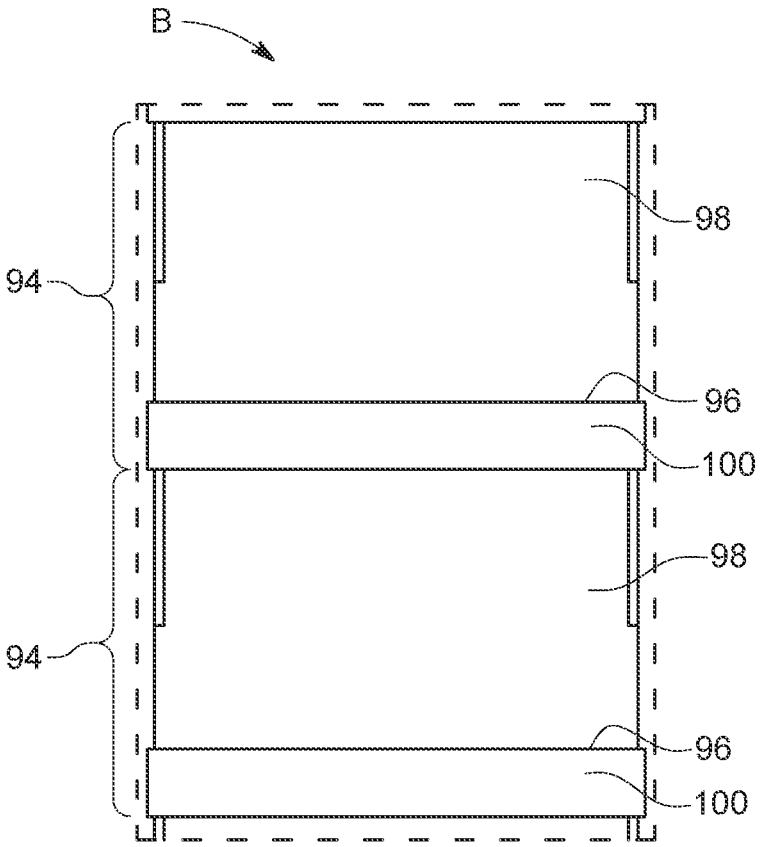
FIG. 5*b* illustrates Section B of FIG. 5*a*, in accordance with one embodiment.

FIG. 5*b* illustrates Section B of FIG. 5*a*. Each shelf section 94 comprises a front fold line 96 and a panel 98. Folding along the front fold line 96 forms front shelf extension 100. The height of the panel 96 corresponds to the depth of the formed shelf. As shown, an upper portion of the panel 98 may be slightly narrower than a lower portion. The narrower section may correspond to the area of the panel that is coextensive with the shelves of the interior unit when the shelved display stand is assembled. Placement of the front fold lines 96 in the exterior unit blank may generally correspond to placement of the front fold lines 50 of the interior unit blank.

Figure 5C:
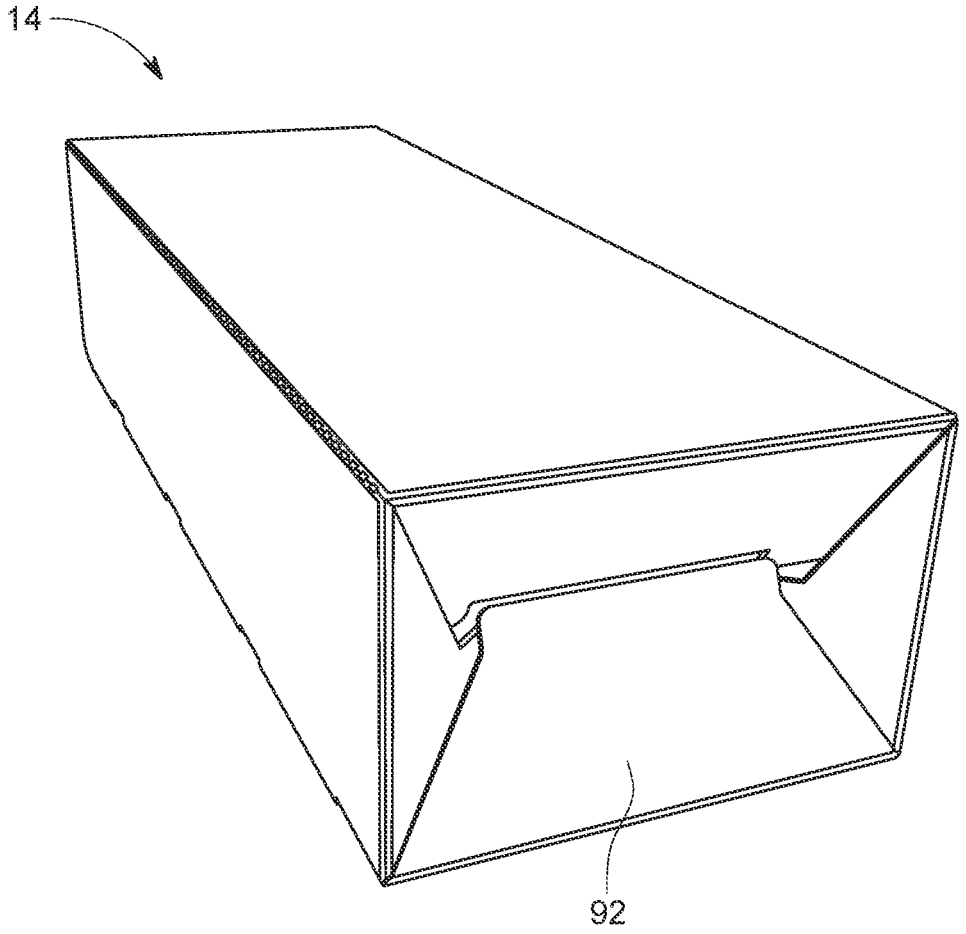
FIG. 5*c* illustrates an assembled exterior unit, in accordance with one embodiment.

FIG. 5*c* illustrates an assembled exterior unit, in accordance with one embodiment. To assemble the exterior unit, the blank is folded along the vertical fold lines 80 and the glue line 82 is exposed to adhere the left side panel 84 to the rear panel 90. If provided, the extension pieces 92 are engaged to form a bottom surface of the exterior unit. This configuration is shown in FIG. 5*c*.

Figure 5D:
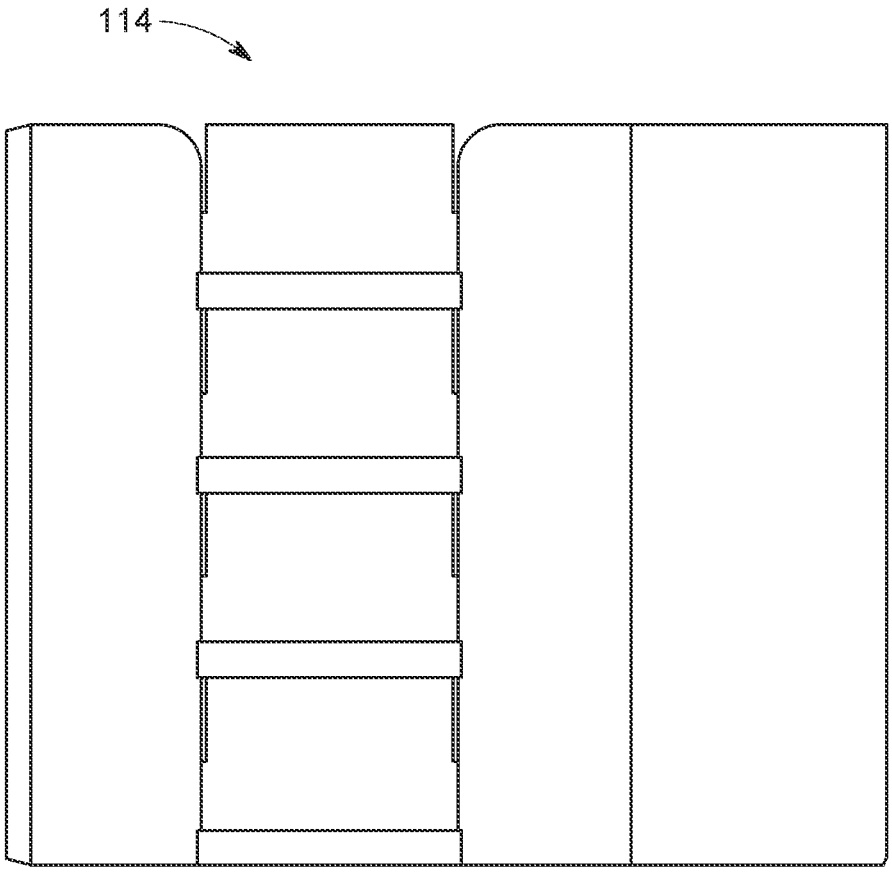
FIG. 5*d* illustrates an exterior unit blank for forming an exterior unit having an open bottom, in accordance with one embodiment.
Figure 5E:
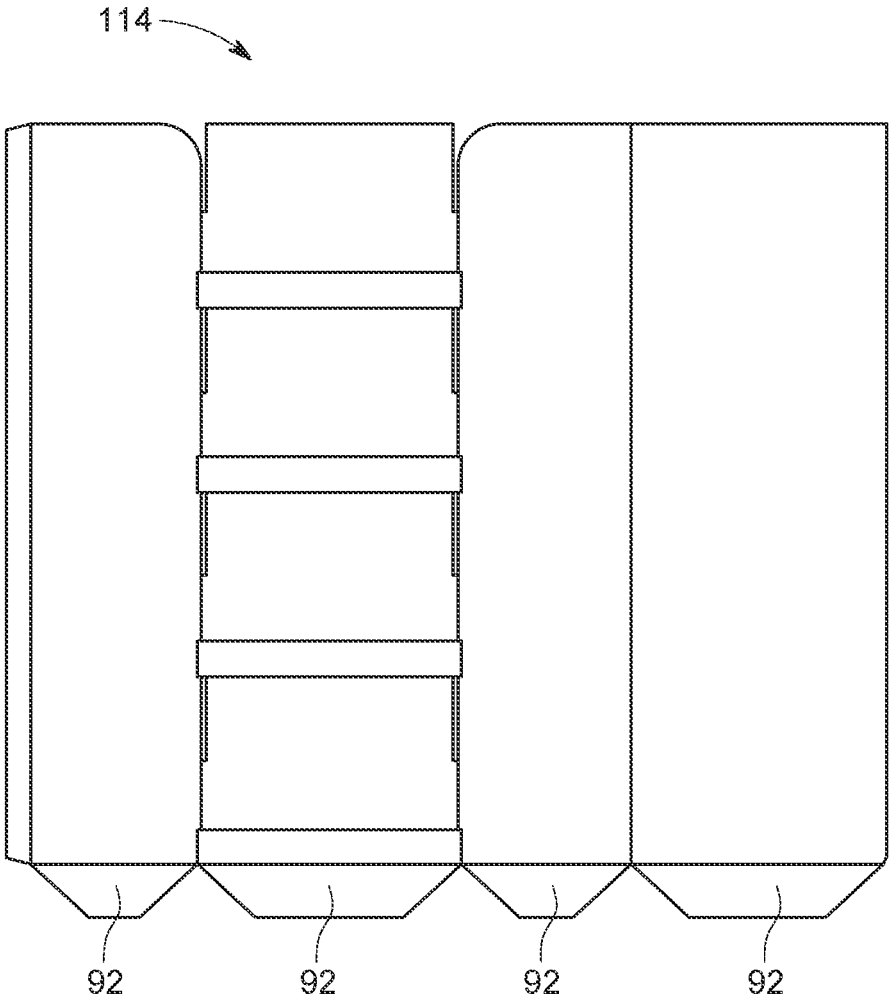
FIG. 5*e* illustrates an exterior unit blank for forming an exterior unit having a partially closed bottom, in accordance with one embodiment.

FIG. 5*d* illustrates an exterior unit blank for forming an exterior unit having an open bottom. In this embodiment, no extension pieces 92 are provided. FIG. 5*e* illustrates an alternative closed bottom exterior unit blank wherein the extension pieces 92 have a smaller profile. The embodiment of FIG. 5*e* forms a partially closed exterior unit.

Figure 5F:
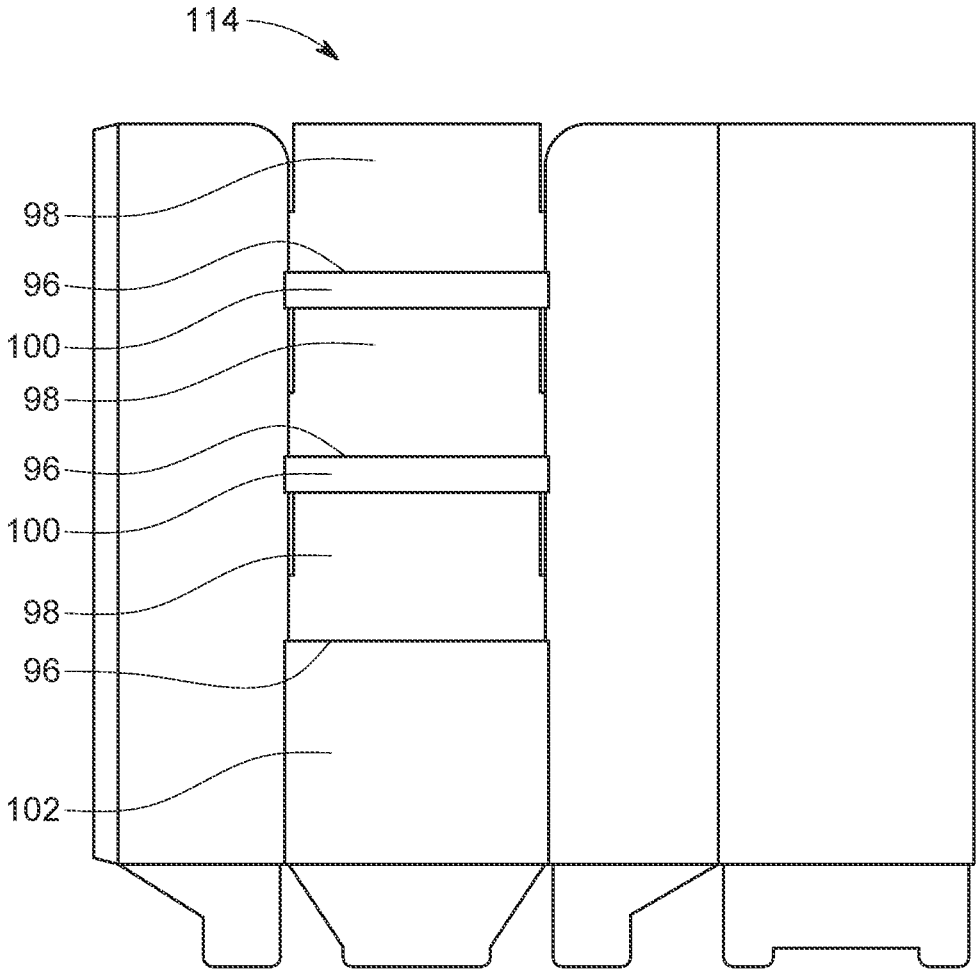
FIG. 5*f* illustrates an embodiment of an exterior unit blank for forming an exterior unit having three shelves and a display surface, in accordance with one embodiment.

FIG. 5*f* illustrates an embodiment of an exterior unit blank 114 for forming an exterior unit having three shelves and a display surface 102 for displaying, for example, information about a product to be displayed by the assembled shelved display unit. As shown, the exterior unit blank 114 includes three front fold lines 96, each having a corresponding panel 98 for forming a shelf. Two shelf extensions 100 are provided, with the display surface 102 being provided in place of a third shelf extension 100. While the display surface 102 is shown at a lower portion of the exterior unit, it could alternatively be at an upper portion or generally centrally located.

Figure 6A:
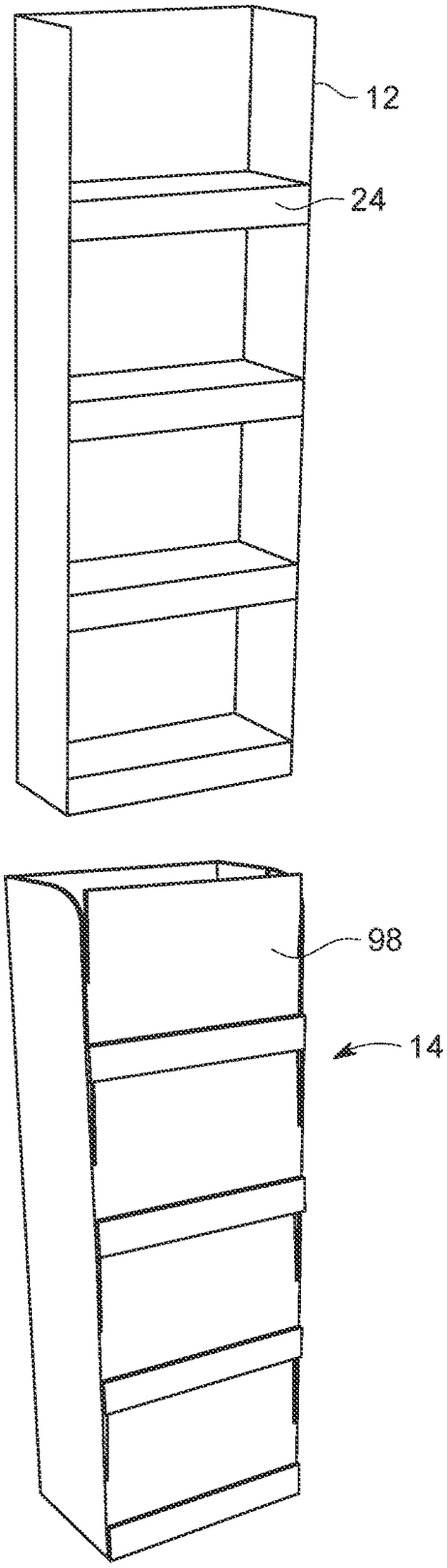
FIG. 6*a* illustrates an interior unit positioned to be slid into an exterior unit, in accordance with one embodiment.

After each of the interior unit 12 and the exterior unit 14 are assembled, the interior unit 12 is slid into the exterior unit 14 (or the exterior unit 14 is slid over the interior unit 12). FIG. 6*a* illustrates the interior unit 12 positioned to be slid into the exterior unit 14. As shown, at this stage, the shelves 24 of the interior unit 12 are fully formed while the panels 98 of the exterior unit are in a vertical orientation.

Figure 6B:
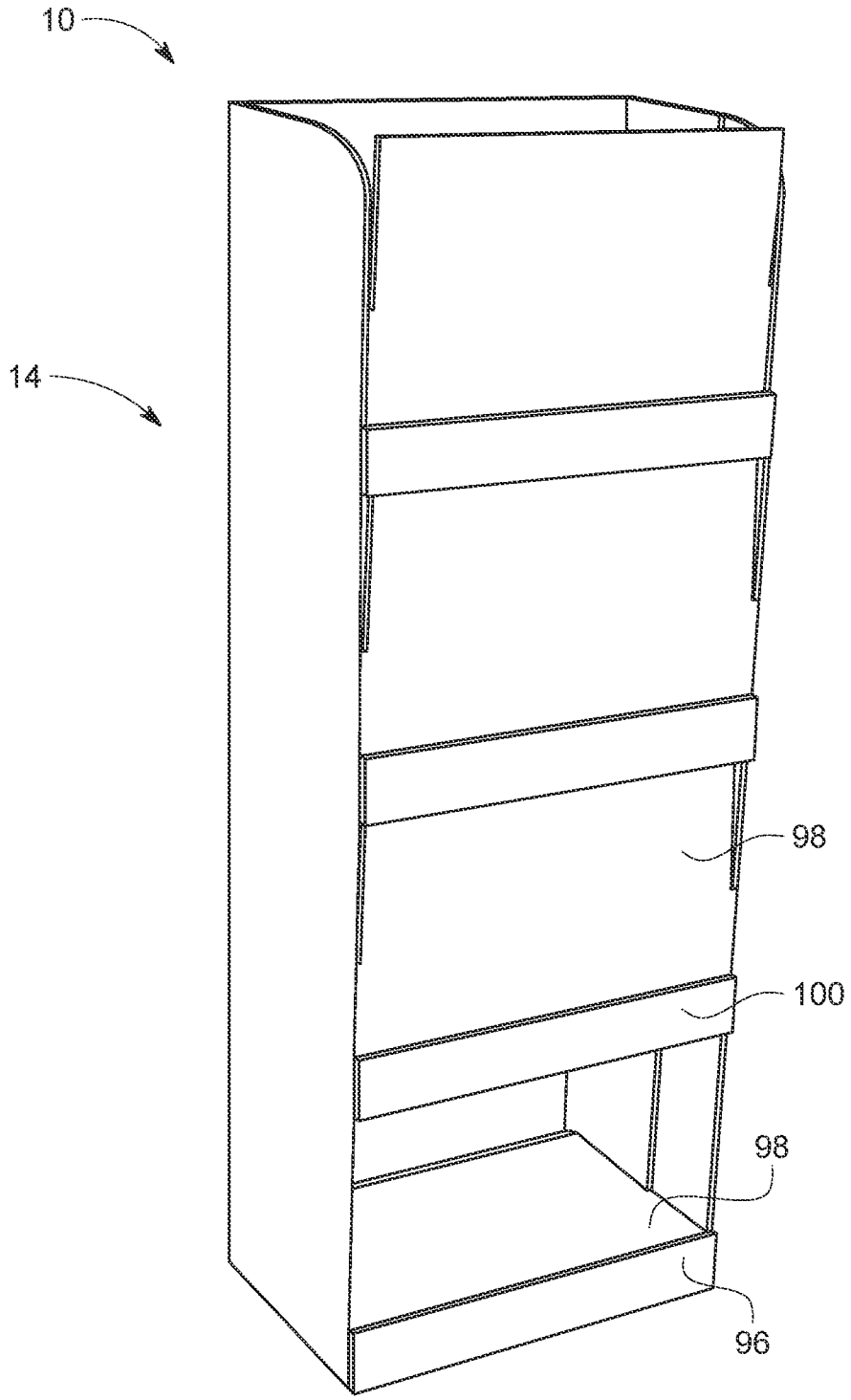
FIG. 6*b* illustrates a partially assembled display stand, in accordance with one embodiment.
Figure 6C:
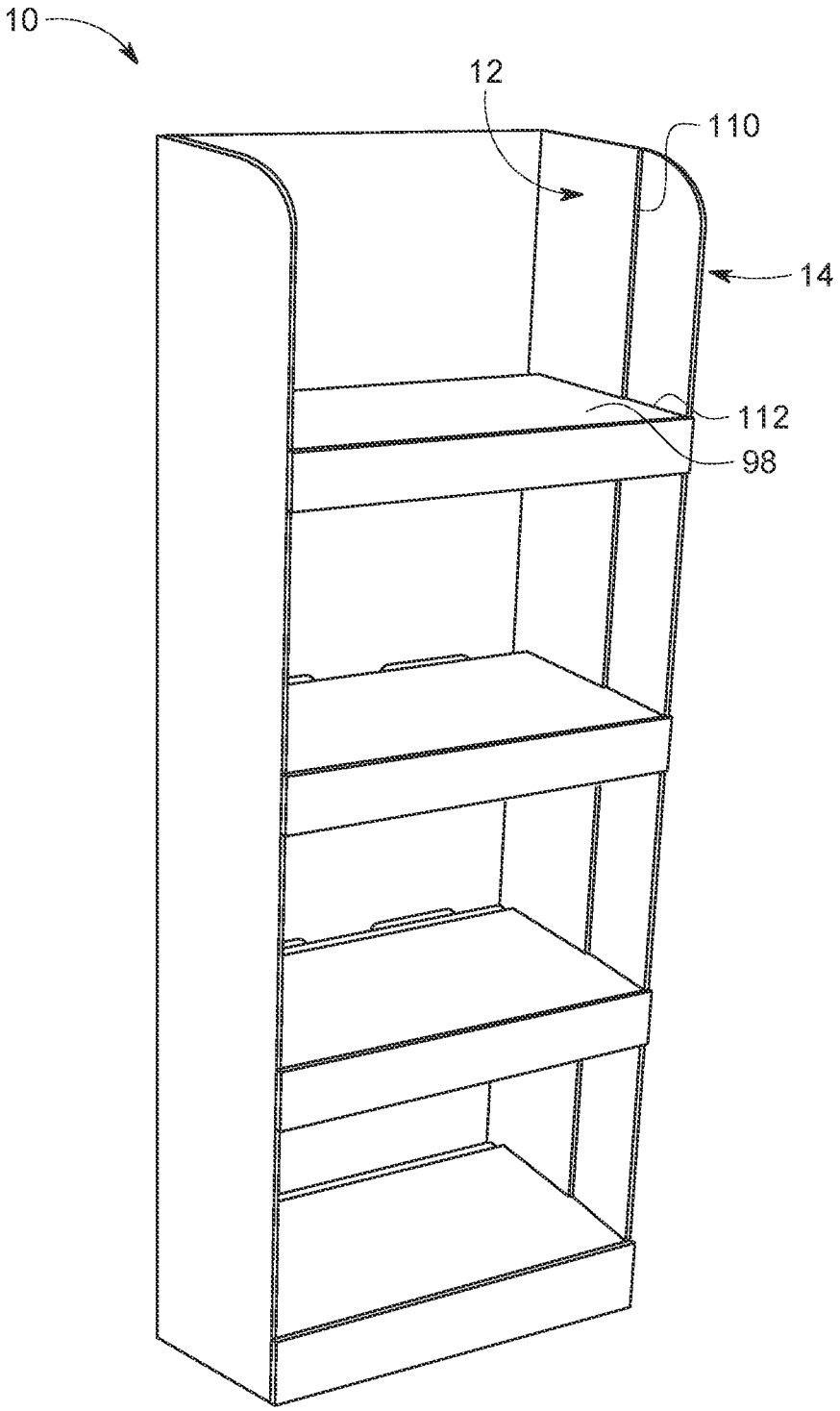
FIG. 6*c* illustrates an assembled shelved display stand, in accordance with one embodiment.

After the interior unit 12 is received by the exterior unit 14, the exterior unit panels 98 are folded along front fold lines 96 and the panels 98 pressed against the shelves 24 of the interior unit. FIG. 6*b* illustrates the interior unit 12 received by the exterior unit 14 and a bottom panel 98 folded along front fold line 96. In FIG. 6*b*, remaining panels 98 are still in a vertical orientation. FIG. 6*c* illustrates all panels 98 having been folded to form a fully assembled shelved display stand 10, in accordance with one embodiment. In the embodiment shown, the front shelf extension 100 forms a flat shelf lip. In alternative embodiments, other geometries may be used. For example, a profile piece may be provided (integrally or as an additional component) to extend above the surface of the shelf in front of product positioned on the shelf to assist in securing the product.

As discussed, in the embodiments shown, the interior unit shelf depth (and depth of unit) is less than the exterior unit shelf depth. Accordingly the front end 110 of the sides 22 of the interior unit 12 can be seen. The area 112 of the panel 98 of the exterior unit 14 is thus slightly wider than the area of the panel coextensive with the interior unit shelf.

Figure 7A:
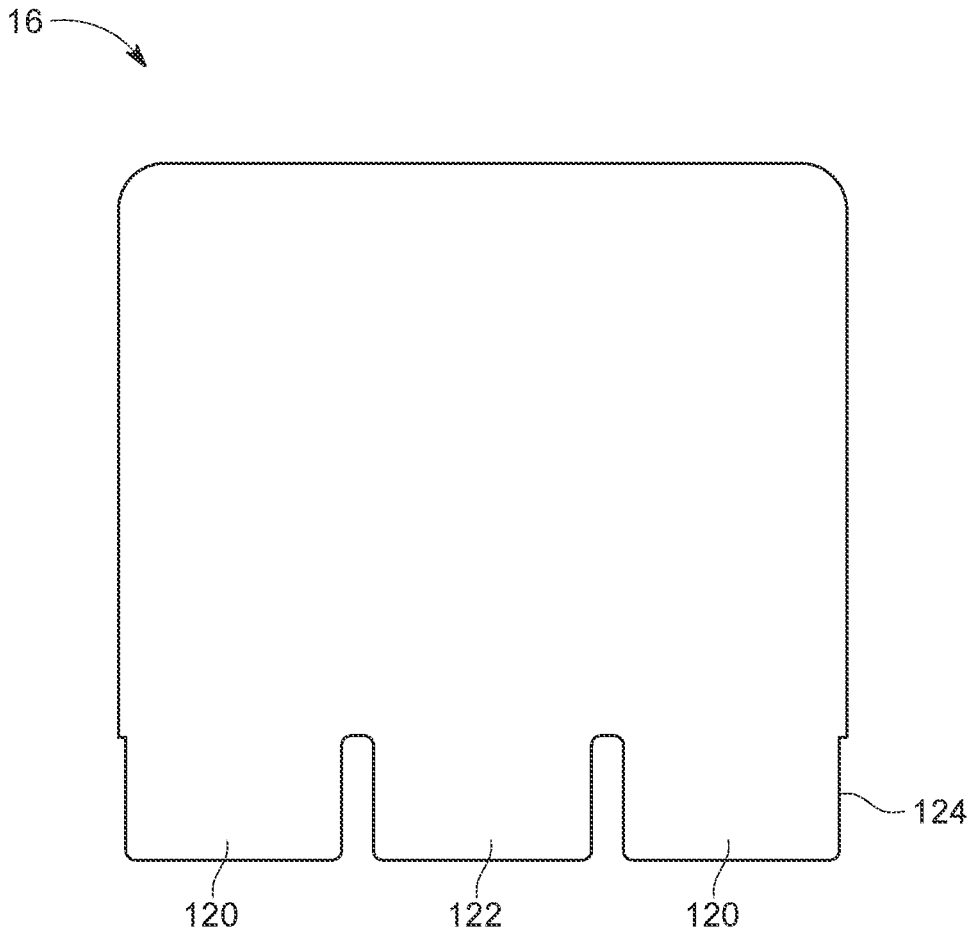
FIG. 7*a* illustrates a one-sided header card, in accordance with one embodiment.
Figure 7B:
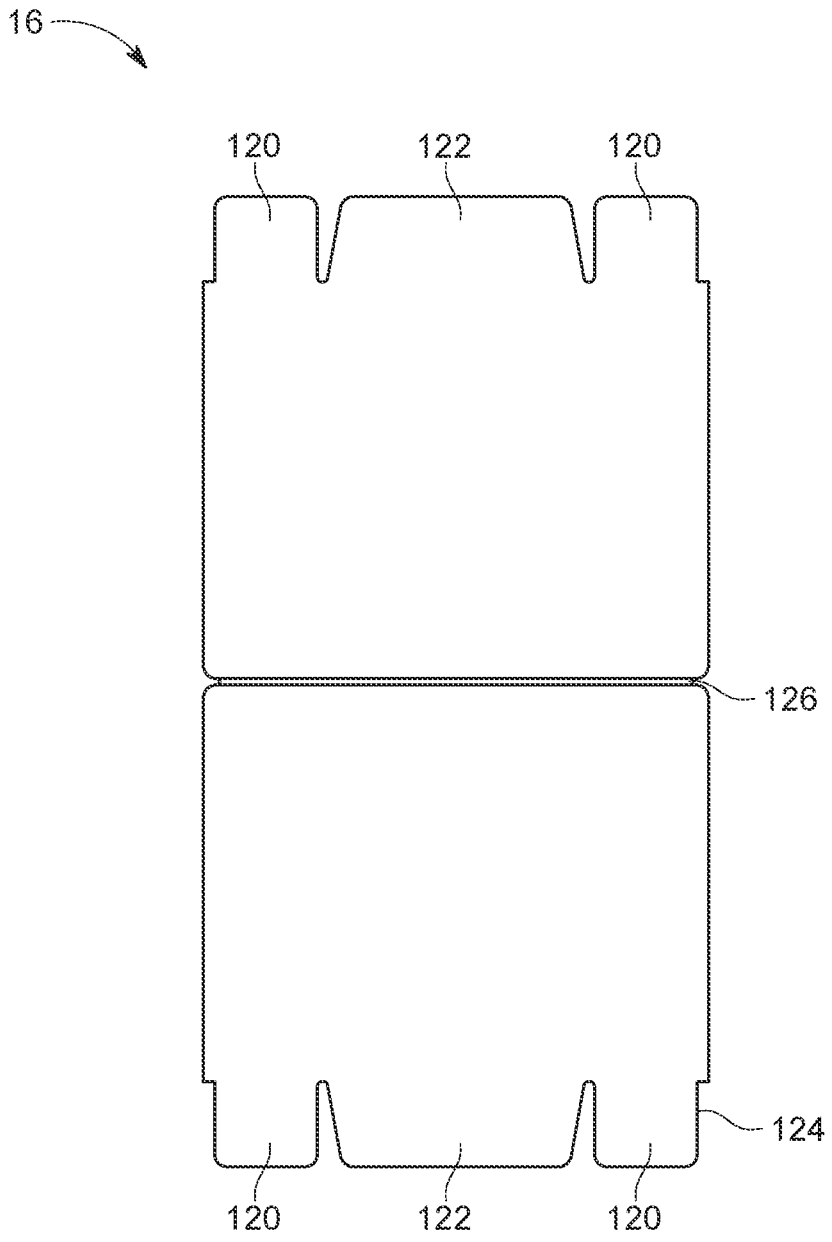
FIG. 7*b* illustrates a two-sided header card, in accordance with one embodiment.

In some embodiments, the shelved display stand may include a header card 16. The header card may be, for example, a graphic header card 16. FIG. 7*a* illustrates a one-sided header card 16. FIG. 7*b* illustrates a two-sided header card 16. The header card may be printed on one or both sides of the card. The header card is not weight bearing and thus may be optimized for printability without regard to strength. While the shown header cards are rectangular, any shape or design of header card could be used.

Figure 8:
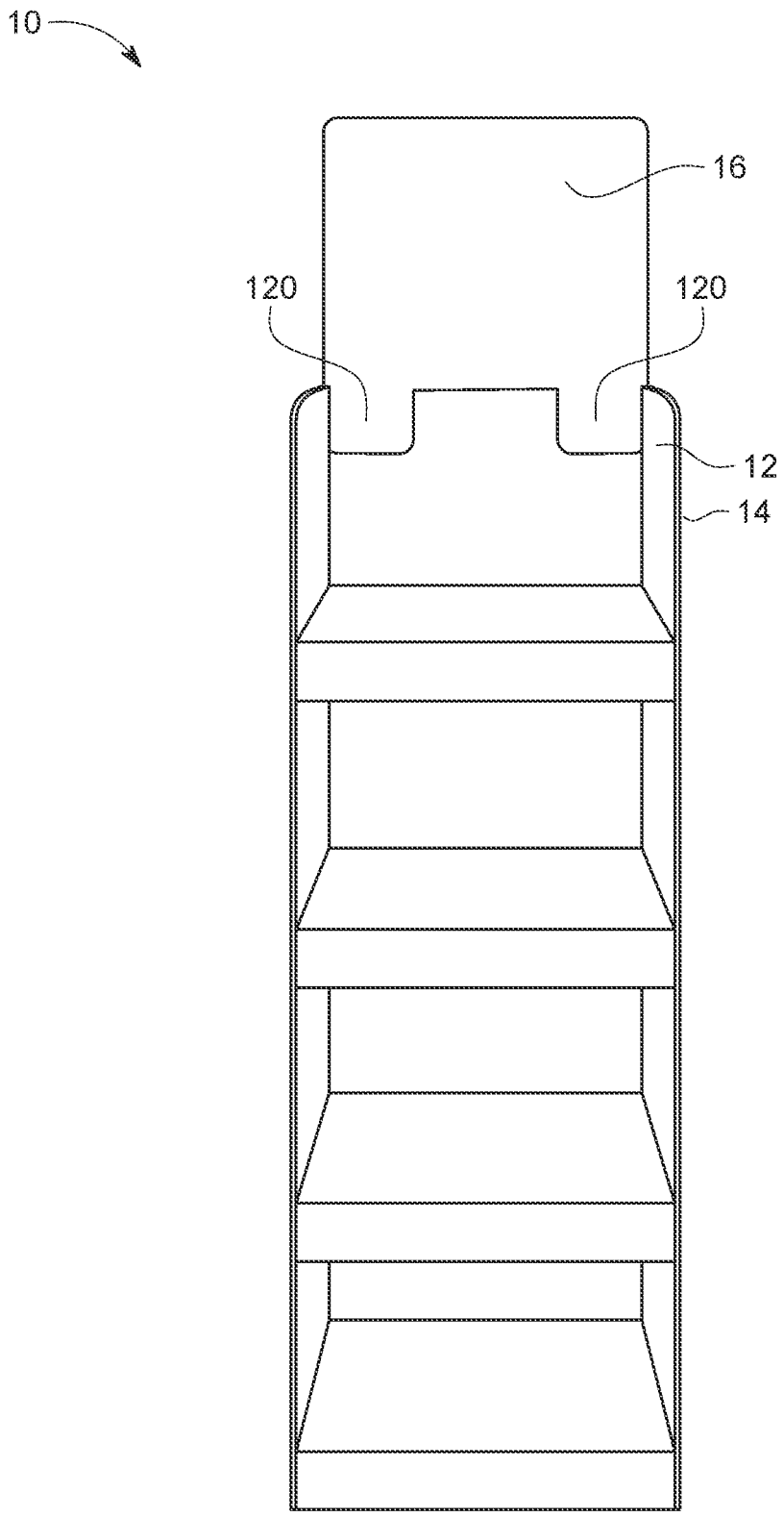
FIG. 8 illustrates a header card positioned on a combined interior unit and exterior unit, in accordance with one embodiment.

The header cards have a top edge, a bottom edge, a left side edge, and a right side edge. The bottom edge may include tabs for receipt by the display unit or may otherwise be attached to the display unit. In the embodiments shown, three tabs are provided. More specifically, two outside tabs 120 and one inside tab 122 are provided. These tabs alternately are inserted between the interior unit and the exterior unit, in front of the interior unit, or behind the exterior unit, providing a weaving of the header card 16 relative the combined interior unit and exterior unit. It is to be appreciated that more or fewer tabs may be provided. A notch 124 may be provided at the lower portion of the header card 16 for receipt within the interior unit. The two-sided card has a fold line 126 generally central to the length of the card such that the two-sided card may be folded along the fold line 126 to form the header card 16. FIG. 8 illustrates a header card 16 positioned on the combined interior unit 12 and exterior unit 14. As shown, the outside tabs 120 are positioned inside the interior unit 12 while the inside tab is positioned behind the exterior unit 14.

Figure 9:
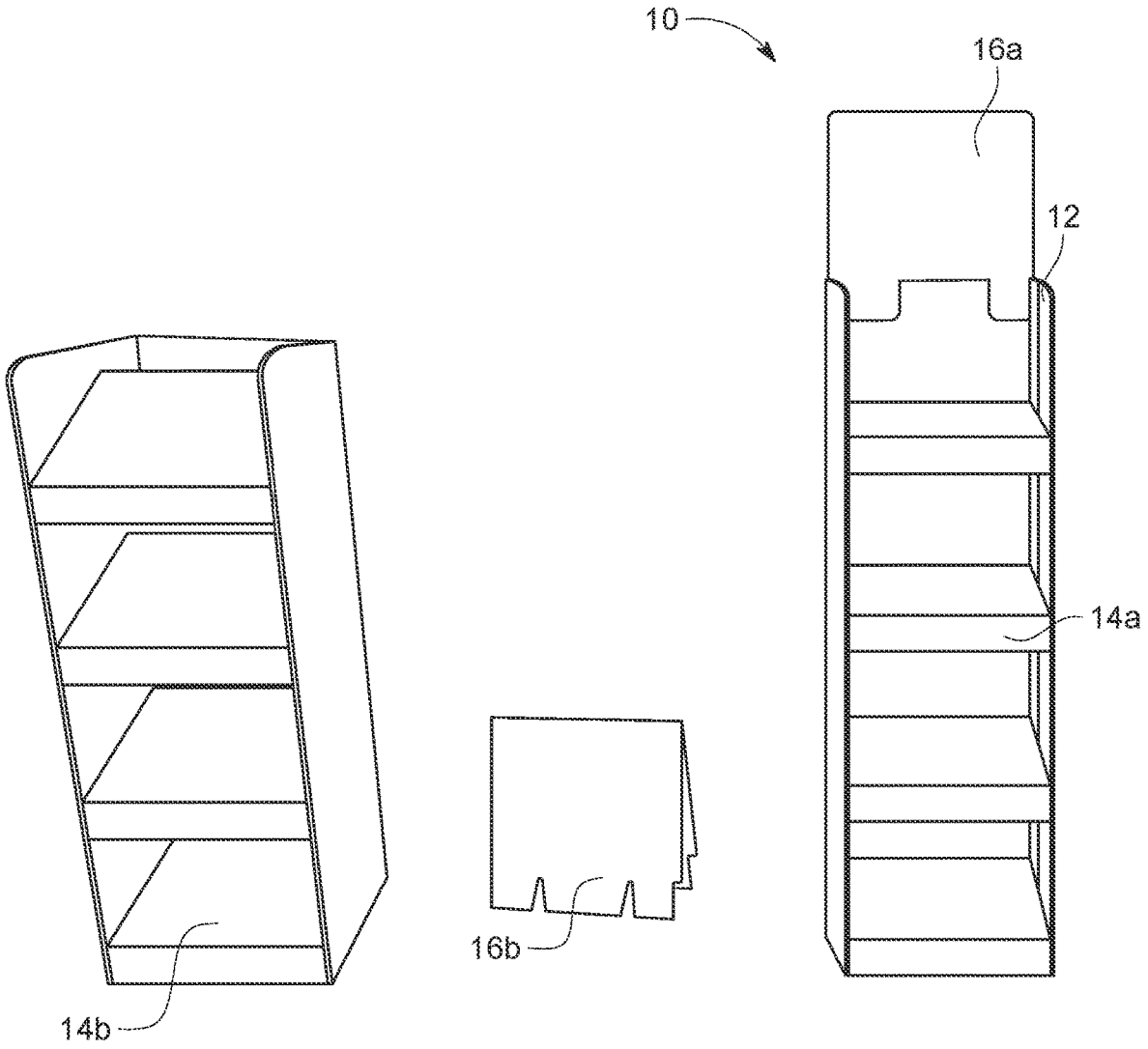
FIG. 9 illustrates an assembled display unit, a replacement exterior unit, and a replacement header card 16*b*, in accordance with one embodiment.

The interior unit 12 is reusable. More specifically, the exterior unit 14 (and header card if provided) can be removed from the interior unit 12 and a replacement exterior unit and header card (with different printing or graphics) may be placed thereover. FIG. 9 illustrates an assembled display unit including an interior unit 12, an exterior unit 14*a*, and a header card 16*a* as well as a replacement exterior unit 14*b* and a replacement header card 16*b*. The exterior units 114*a* and 114*b* and the header cards 16*a* and 16*b* have differing graphics.

In general, the shelved display stand may be configured so that the interior unit is substantially covered by the exterior unit. The interior unit may thus be optimized for strength without regard to printability. The blanks may be formed from a variety of materials including corrugated paperboard, folding carton, solid fiber, plastic sheeting, plastic corrugated, combinations thereof, or any other suitable material. In some embodiments, the interior unit thus may comprise a strong, heavy material such as a thick corrugated cardboard. With the interior unit providing strength and stability to the shelved display stand, the exterior unit may be optimized for printability and may be weaker. Alternatively, each of the interior unit and the exterior unit may comprise the same material. In general, the shelved display stand is capable of supporting up to thirty to fifty pounds per shelf. For a shelved display stand having four shelves, the unit is capable of supporting 120 to 200 pounds.

Figure 10:
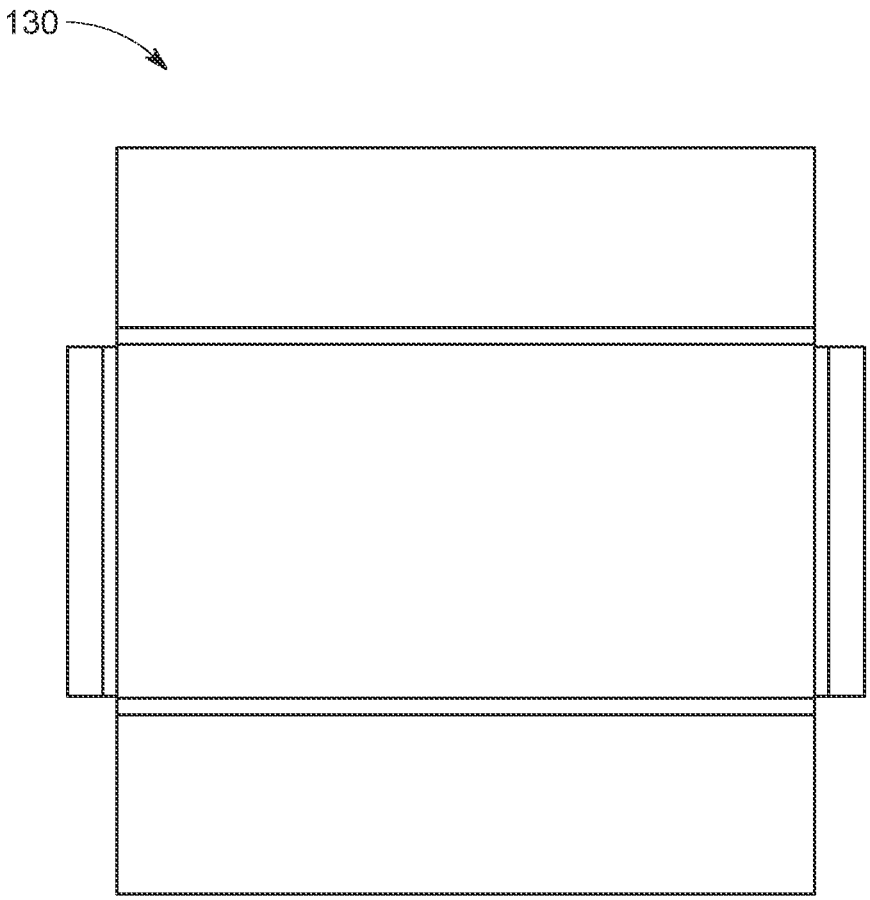
FIG. 10 illustrates such a shipping unit in a flat unassembled configuration, in accordance with one embodiment.

The interior unit and the exterior unit may be shipped flat in a one piece shipping unit. FIG. 10 illustrates such a shipping unit 130 in a flat unassembled configuration.

Figure 11A:
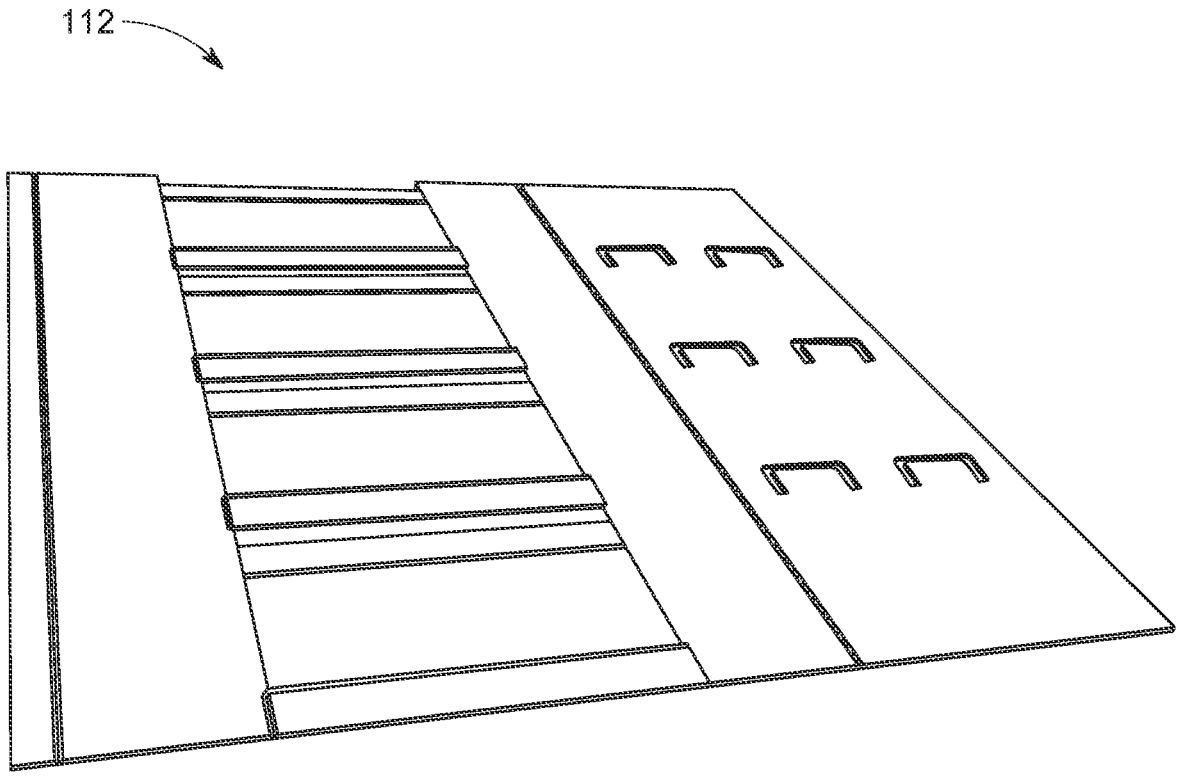
FIG. 11*a* illustrates an interior unit blank, in accordance with one embodiment.
Figure 11B:
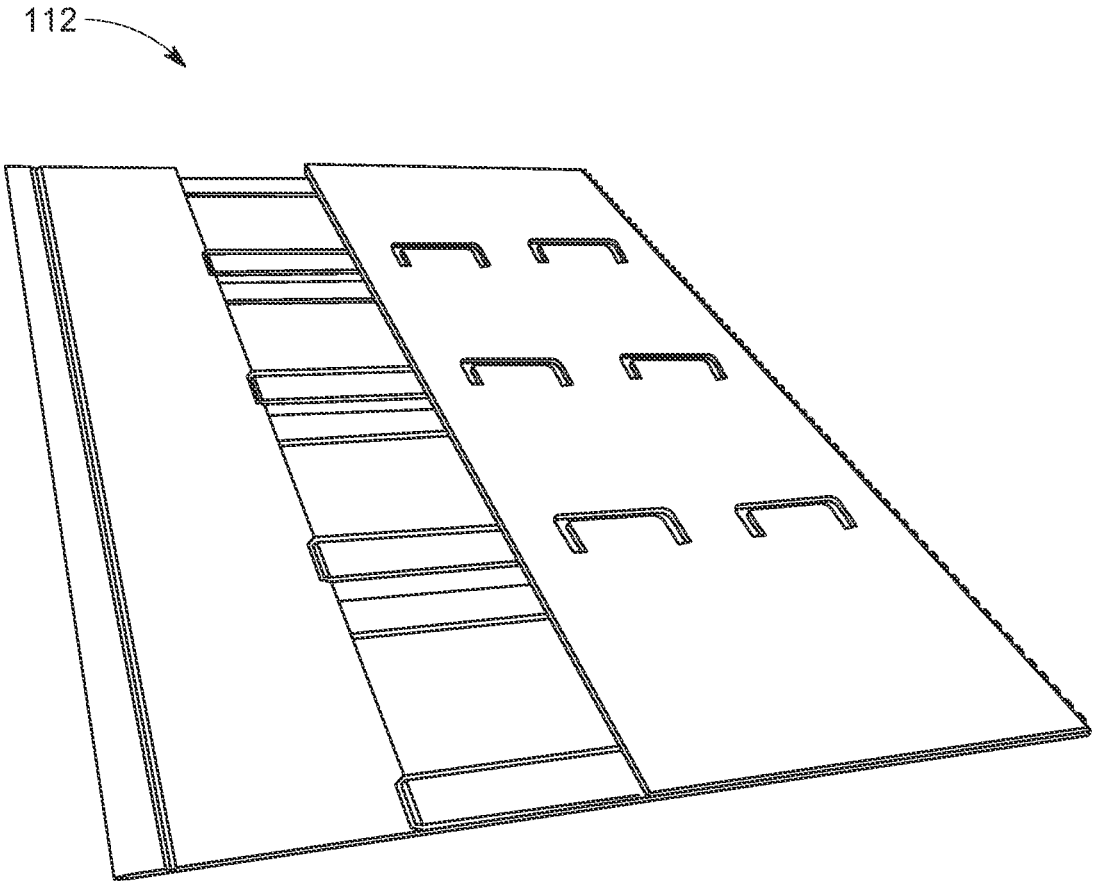
FIG. 11*b* illustrates an interior unit blank, in accordance with one embodiment.
Figure 11C:
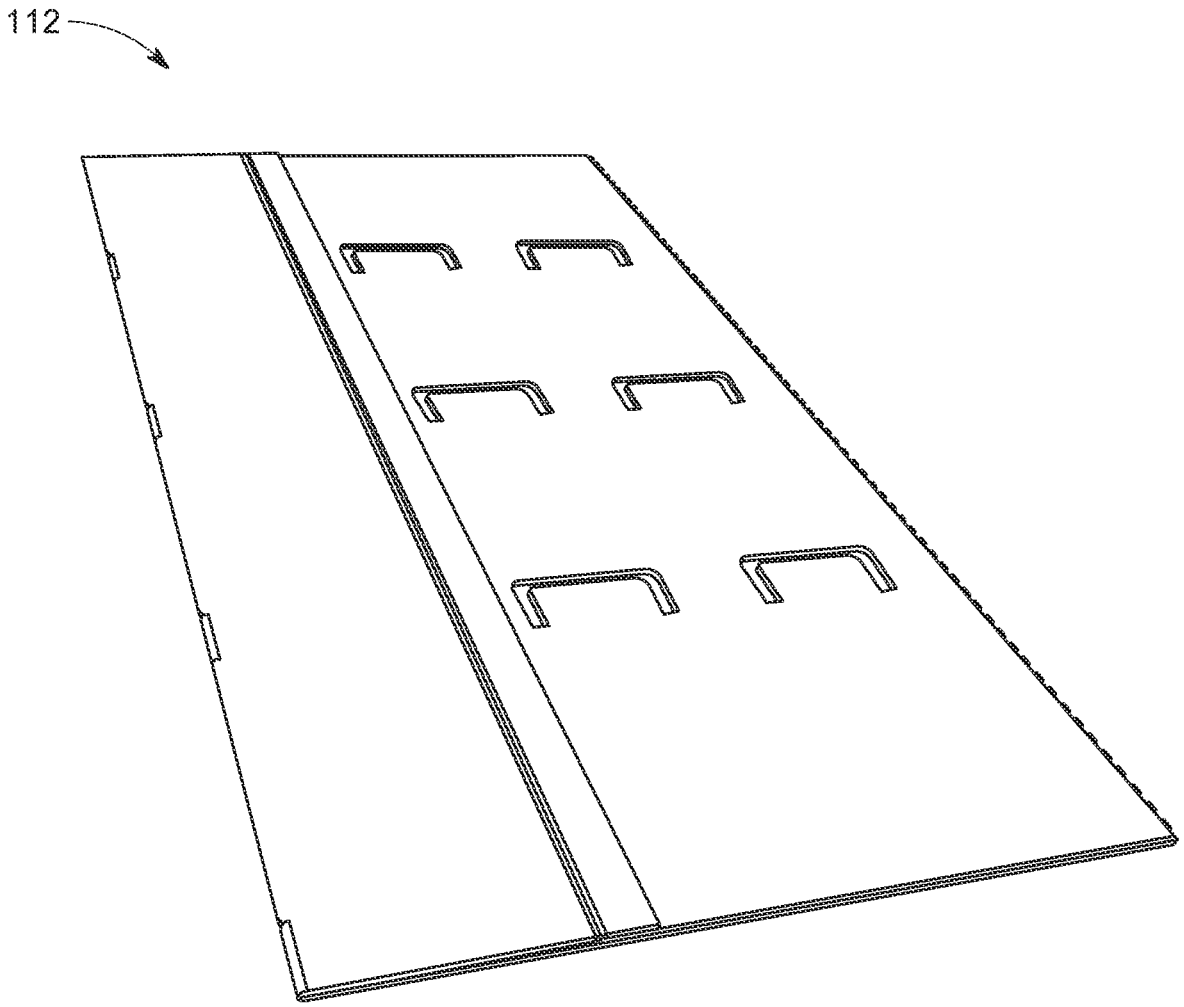
FIG. 11*c* illustrates an interior unit blank, in accordance with one embodiment.
Figure 12A:
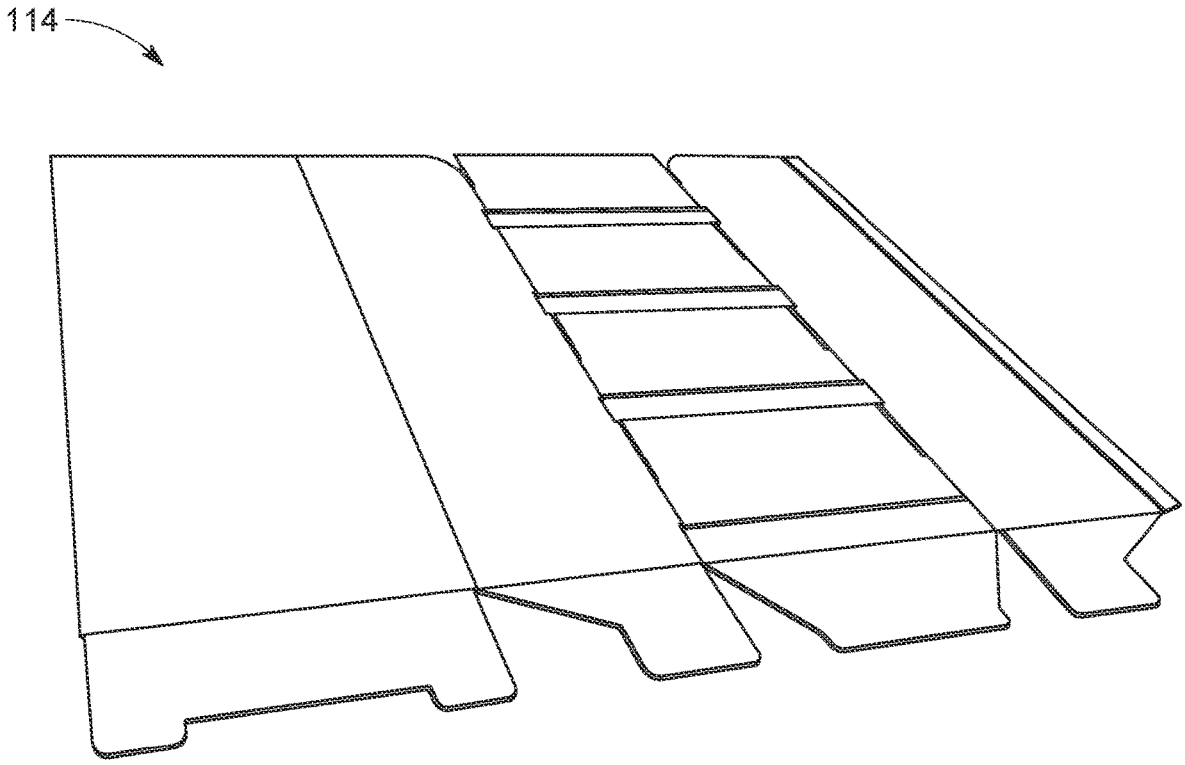
FIG. 12*a* illustrates an exterior unit blank, in accordance with one embodiment.
Figure 12B:
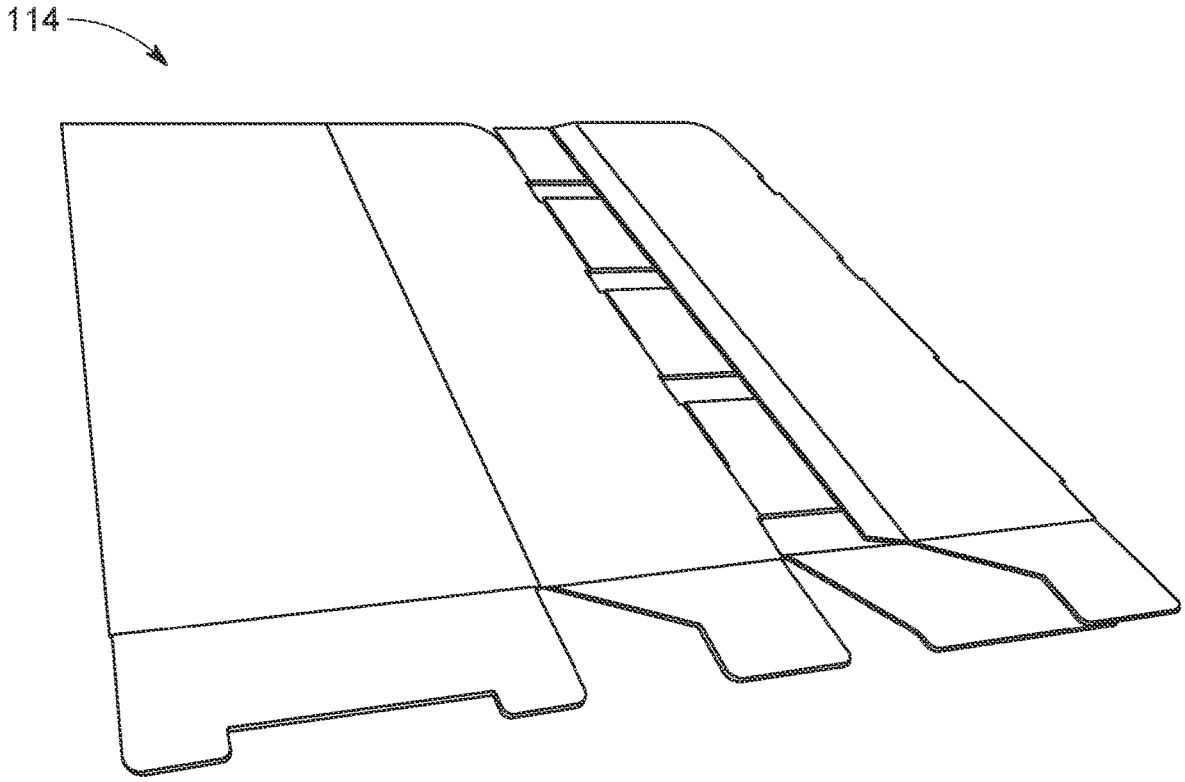
FIG. 12*b* illustrates an exterior unit blank, in accordance with one embodiment.
Figure 12C:
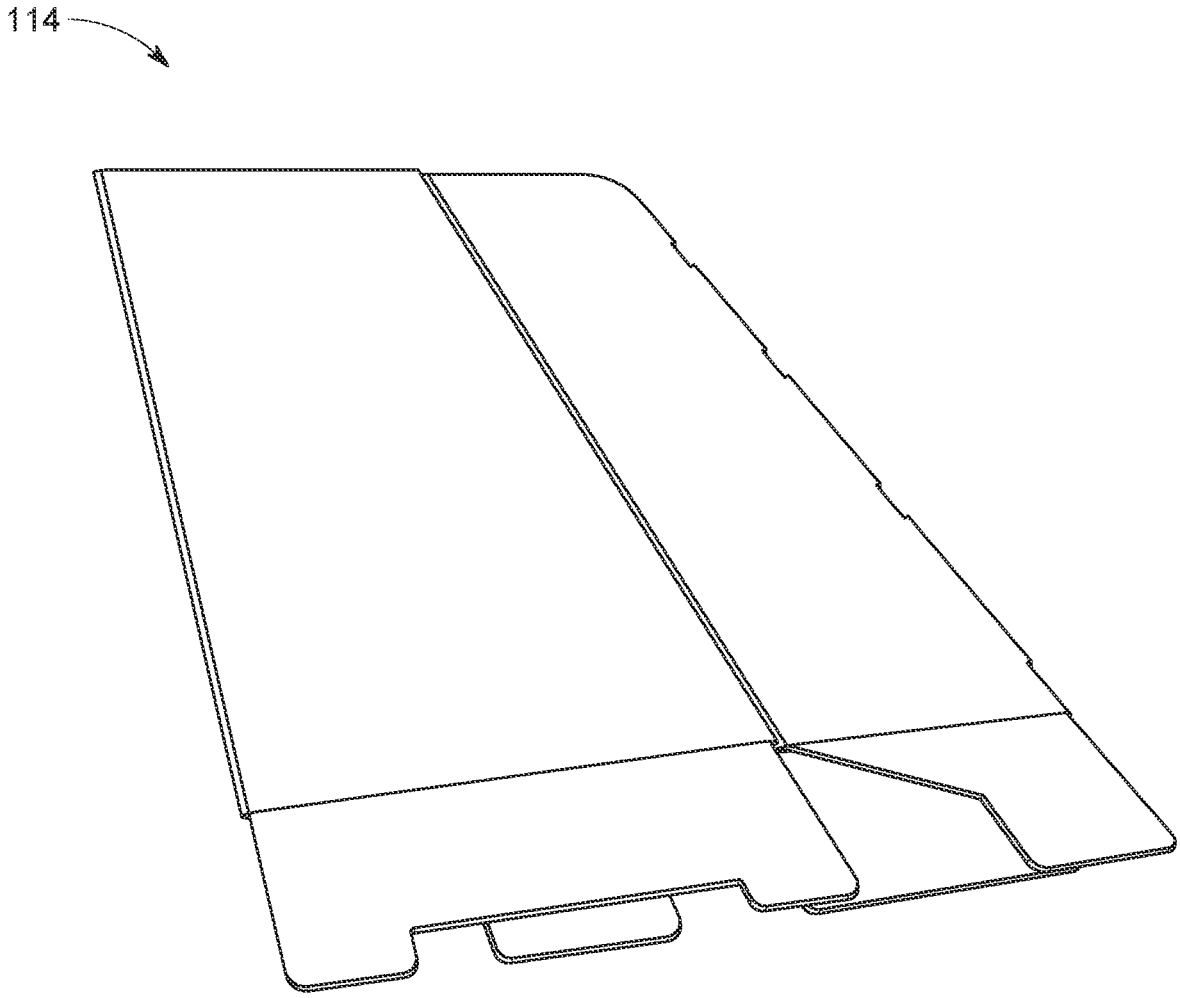
FIG. 12*c* illustrates an exterior unit blank, in accordance with one embodiment.

FIGS. 11*a*-11*c* illustrate various embodiments of an interior unit blank 112. More specifically, FIGS. 11*a*-11*c* illustrate a folding sequence for gluing interior unit 12. FIGS. 12*a*-12*c* illustrate various embodiments of an exterior unit blank 114. More specifically, FIGS. 12*a*-12*c* illustrate a folding sequence for gluing exterior unit 14.

Upon unpacking, each of the interior unit and the exterior unit are assembled. Assembly generally comprises folding along fold lines and adhering along glue lines. In some embodiments, an adhesive strip may be provided along one or more glue lines prior to shipping and a protective cover removed after unpacking to expose the adhesive strip. Alternatively, glue or other adhesive may be applied after unpacking.

Initial assembly comprises folding and gluing the interior unit blank to form an interior unit as shown in FIG. 3*c*, folding along the front fold lines to direct the panels rearwardly, and inserting the rear tab(s) into the slot(s) of the rear surface of the interior unit to provide a configuration substantially as shown in FIG. 2. The exterior unit blank is folded and glued to form an exterior unit substantially as shown in FIG. 5*c*. The exterior unit is slid over the interior unit, as shown in FIG. 6*a*. The exterior unit panels are folded inwardly to form a shelved display stand as shown in FIG. 6*c*. A header card may be placed over the shelved display stand, as shown in FIG. 1.

The shelved display stand is customizable and can be configured to a variety of sizes and with any number of shelves to meet brands' visual merchandising needs. The interior unit can be reused with replaceable exterior units and/or header cards.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context.

However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A display stand comprising:

an interior unit having a front surface and a back surface, wherein the front surface includes at least one shelf section, and the back surface includes at least one slot for receiving the at least one shelf section;

an exterior unit having a front surface and a back surface, and a bottom, wherein the front surface includes at least one shelf extension;

wherein, in an assembled condition:

the interior unit front surface lines up with the exterior unit front surface and the interior unit back surface lines up with the exterior unit back surface; and the at least one exterior unit shelf extension is folded over a portion of the at least one interior unit shelf section.

2. The display stand of claim 1, wherein the at least one shelf section comprises a front fold line and a rear fold line wherein folding along the rear fold line forms a rear tab that is received by the at least one slot.

3. The display stand of claim 1, wherein the interior unit back surface includes two slots for receiving the at least one shelf section.

4. The display stand of claim 1, wherein the at least one shelf extension comprises a front fold line and a panel.

5. The display stand of claim 4, wherein the interior unit shelf section has a length that is less than a length of the panel.

6. The display stand of claim 1, wherein the exterior unit includes at least one of printed text and graphics and the interior unit does not include printed text or graphics.

7. The display stand of claim 1, wherein the interior unit is formed from an interior unit blank, and wherein the interior unit blank comprises a plurality of vertical fold lines dividing the interior unit blank into a plurality of panels wherein one of the panels of the plurality of panels is a front surface panel correlating to the front surface and one of the panels of the plurality of panels is a back surface panel correlating to the back surface.

8. The display stand of claim 7, wherein the exterior unit is formed from an exterior unit blank, and wherein the exterior unit blank comprises a plurality of vertical fold lines equal to the plurality of vertical fold lines of the interior unit blank.

9. The display stand of claim 7, wherein the exterior unit is formed from an exterior unit blank, and wherein the exterior unit blank comprises a plurality of vertical fold lines more than the plurality of vertical fold lines of the interior unit blank.

10. The display stand of claim 7, wherein the exterior unit is formed from an exterior unit blank, wherein the exterior unit blank comprises a first side surface panel and a second side surface panel, wherein each of the exterior unit front surface panel, the exterior unit back surface panel, the exterior unit first side surface panel, and the exterior unit second side surface panel includes an extension piece, wherein the extension pieces cooperate to close the bottom of the display stand.

11. The display stand of claim 1, further comprising a header card positioned on at least one of the interior unit and the exterior unit in the assembled condition.

12. The display stand of claim 11, wherein the interior unit is formed from an interior unit blank and the exterior unit is formed from an exterior unit blank and wherein each of the interior unit blank, the exterior unit blank, and the header card is flat.

13. The display stand of claim 1, wherein the interior unit front surface includes four shelf sections and the exterior unit front surface includes four shelf extensions.

14. A display stand comprising:

an interior unit having a front surface and a back surface, wherein the front surface includes at least one shelf section, and the back surface includes at least one slot for receiving the at least one shelf section, wherein the at least one shelf section comprises a front fold line and a rear fold line wherein folding along the rear fold line forms a rear tab that is received by the at least one slot;

an exterior unit having a front surface and a back surface, and a bottom, wherein the front surface includes at least one shelf extension comprising a front fold line and a panel;

wherein, in an assembled condition:

the interior unit front surface lines up with the exterior unit front surface and the interior unit back surface lines up with the exterior unit back surface; and the at least one exterior unit shelf extension is folded over a portion of the at least one interior unit shelf section.

15. The display stand of claim 14, wherein the interior unit shelf section has a length that is less than a length of the exterior unit panel.

* * * * *